US008505333B2

(12) United States Patent
Evans et al.

(10) Patent No.: US 8,505,333 B2
(45) Date of Patent: Aug. 13, 2013

(54) OPTIMIZED HEAVIES REMOVAL SYSTEM IN AN LNG FACILITY

(75) Inventors: Megan V. Evans, Houston, TX (US); Attilio J. Praderio, Houston, TX (US); Lisa M. Strassle, Ponca City, OK (US); Mohan S. Chahal, Houston, TX (US); Matthew C. Gentry, Katy, TX (US); Wesley R. Qualls, Katy, TX (US); Marc T. Bellomy, Cypress, TX (US); James L. Rockwell, Houston, TX (US)

(73) Assignee: ConocoPhilips Company, Houston, TX (US)

( * ) Notice: Subject to any disclaimer, the term of this patent is extended or adjusted under 35 U.S.C. 154(b) by 1254 days.

(21) Appl. No.: 12/330,860

(22) Filed: Dec. 9, 2008

(65) Prior Publication Data

US 2009/0301132 A1 Dec. 10, 2009

Related U.S. Application Data

(60) Provisional application No. 61/012,572, filed on Dec. 10, 2007.

(51) Int. Cl.
*F25J 3/00* (2006.01)

(52) U.S. Cl.
USPC ..... 62/630; 62/618; 62/620; 62/631

(58) Field of Classification Search
USPC ..... 62/611, 620, 625, 630, 631
See application file for complete search history.

(56) References Cited

U.S. PATENT DOCUMENTS

| | | | | |
|---|---|---|---|---|
| 2,164,593 | A | 3/1937 | Rector | |
| 4,445,916 | A | 5/1984 | Newton | |
| 4,474,591 | A | 10/1984 | Arand et al. | |
| 5,363,655 | A | 11/1994 | Kikkawa et al. | |
| 5,893,274 | A * | 4/1999 | Nagelvoort et al. | 62/613 |
| 6,112,549 | A | 9/2000 | Yao et al. | |
| 6,116,050 | A | 9/2000 | Yao et al. | |
| 6,401,486 | B1 | 6/2002 | Lee et al. | |
| 6,662,589 | B1 | 12/2003 | Roberts et al. | |
| 7,257,966 | B2 * | 8/2007 | Lee et al. | 62/620 |
| 2006/0260355 | A1 | 11/2006 | Roberts et al. | |
| 2007/0012071 | A1 | 1/2007 | Huang et al. | |
| 2007/0012072 | A1 * | 1/2007 | Qualls et al. | 62/613 |
| 2007/0056318 | A1 * | 3/2007 | Ransbarger | 62/611 |
| 2007/0208432 | A1 | 9/2007 | Hawrysz | |

FOREIGN PATENT DOCUMENTS

| | | | |
|---|---|---|---|
| WO | 2006071261 | A2 | 7/2006 |
| WO | 2007008525 | A2 | 1/2007 |

* cited by examiner

*Primary Examiner* — Frantz Jules
*Assistant Examiner* — Keith Raymond
(74) *Attorney, Agent, or Firm* — ConocoPhillips Company

(57) ABSTRACT

An LNG facility employing an optimized heavies removal system. The optimized heavies removal system can comprise at least one distillation column and at least two separate heat exchangers. The heat exchangers can be operable to heat a liquid stream withdrawn from a distillation column to thereby provide predominantly vapor and/or liquid streams that can be reintroduced into the column.

18 Claims, 8 Drawing Sheets

OPTIMIZED HEAVIES REMOVAL SYSTEM IN AN LNG FACILITY

CROSS REFERENCE TO RELATED APPLICATIONS

The present application claims priority to and incorporates by reference in its entirety copending U.S. Provisional Patent Application Ser. No. 61/012,572 filed Dec. 10, 2007, entitled "Optimized Heavies Removal System in an LNG Facility."

BACKGROUND OF THE INVENTION

1. Field of the Invention

This invention relates to systems and processes for liquefying natural gas. In another aspect, the invention concerns LNG processes and facilities employing an optimized heavies removal system.

2. Description of the Related Art

Cryogenic liquefaction is commonly used to convert natural gas into a more convenient form for transportation and/or storage. Because liquefying natural gas greatly reduces its specific volume, large quantities of natural gas can be economically transported and/or stored in liquefied form.

Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers.

Storing natural gas in its liquefied form can help balance out periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Several methods exist for liquefying natural gas. Some methods produce a pressurized LNG (PLNG) product that is useful, but requires expensive pressure-containing vessels for storage and transportation. Other methods produce an LNG product having a pressure at or near atmospheric pressure. In general, these non-pressurized LNG production methods involve cooling a natural gas stream via indirect heat exchange with one or more refrigerants and then expanding the cooled natural gas stream to near atmospheric pressure. In addition, most LNG facilities employ one or more systems to remove contaminants (e.g., water, acid gases, and nitrogen, as well as ethane and heavier components) from the natural gas stream at different points during the liquefaction process.

In general, LNG facilities are designed and operated to provide LNG to a single market in a specific region of the world. Because specifications for the final characteristics of the natural gas product, such as, for example, higher heating value (HHV), Wobbe index, methane content, ethane content, $C_3$+ content, and inerts content, vary widely throughout the world, LNG facilities are typically optimized to meet a certain set of specifications for a single market. In large part, achieving the stringent final product specifications involves effectively removing certain components from the natural gas feed stream. LNG facilities may employ one or more distillation columns to remove these components from the incoming natural gas stream. Oftentimes, the difference in relative volatility between the components being removed and the natural gas stream is small. In addition, at least one of the columns used to separate the undesirable components from the natural gas stream can generally be operated at or near the critical pressure of the components being separated. These limitations, coupled with the rigid product specifications, results in the distillation columns that are typically designed to operate within a relatively narrow range of conditions. When situations arise that force the column out of its design range (e.g., start-up of the facility or fluctuations in feed composition), the resulting unstable column operation may become unstable and may result in product loss and/or result in a LNG product that does not meet the desired product specifications.

SUMMARY OF THE INVENTION

In one embodiment of the present invention, there is provided a process for liquefying a natural gas stream, the process comprising: (a) using a first distillation column to separate at least a portion of the natural gas stream into a first predominately liquid stream and a first predominately vapor stream; (b) heating at least a portion of the first predominately liquid stream in a first heat exchanger to thereby provide a first heated stream; (c) heating at least a portion of the first heated stream in a second heat exchanger to thereby provide a second heated stream, wherein the at least a portion of the first heated stream is not reintroduced into the first distillation column between the first and second heat exchangers; (d) using a second distillation column to separate at least a portion of the second heated stream into a second predominantly liquid stream and a second predominantly vapor stream, wherein at least a portion of the heating of at least one of steps (b) and (c) is provided by indirect heat exchange with at least a portion of the second predominantly vapor stream; and (e) introducing a reboiled vapor fraction of the first and/or second heated streams into the first distillation column.

In another embodiment of the present invention, there is provided a process for liquefying a natural gas stream, the process comprising: (a) introducing at least a portion of the natural gas stream into a first distillation column; (b) withdrawing a first predominantly liquid stream from the first distillation column via a first liquid outlet; (c) heating at least a portion of the first predominately liquid stream in a first heat exchanger to thereby provide a first heated stream; (d) separating at least a portion of the first heated stream in a vapor-liquid separation vessel to thereby provide a first heated vapor fraction and a first heated liquid fraction; (e) heating at least a portion of the first heated liquid fraction in a second heat exchanger; (f) withdrawing a second heated vapor fraction and a second heated liquid fraction from the second heat exchanger; (g) introducing at least a portion of the first and/or second heated vapor fractions into the first distillation column via a first vapor inlet, wherein the first vapor inlet is located at a vertical elevation below the first liquid outlet; and (h) introducing at least a portion of the second heated liquid fraction into the first distillation column via a first liquid inlet, wherein the first liquid inlet is located at a vertical elevation below the first vapor inlet.

In yet another embodiment of the present invention, there is provided a process for liquefying a natural gas stream in a liquefied natural gas (LNG) facility, the process comprising: (a) separating at least a portion of the natural gas stream in a first distillation column to thereby provide a first predominately liquid stream and a first predominately vapor stream; (b) routing the first predominately liquid stream around a first heat exchanger via a bypass line; (c) heating the first predominately liquid stream in a second heat exchanger to thereby provide a second heated stream; (d) separating at least a portion of the second heated stream in a second distillation column to thereby provide a second predominately liquid stream and a second predominately vapor stream; (e) passing at least a portion of the second predominately vapor stream through a cooling pass of the first heat exchanger; (f) adjusting a bypass control mechanism operably coupled to the bypass line so that at least a portion of the first predominately liquid stream is no longer routed around the first heat exchanger; (g) subsequent to step (f), heating the first predominately liquid stream in the first heat exchanger via indirect heat exchange with the second predominately vapor stream to thereby provide a first heated stream; and (h) heating at least a portion of the first heated stream in the second heat exchanger.

In a further embodiment of the present invention, there is provided a liquefied natural gas (LNG) facility comprising a first distillation column, a first heat exchanger, a vapor-liquid separation vessel, a second heat exchanger, and a second distillation column. The first distillation column comprises a first feed inlet, a first bottoms outlet, a first overhead outlet, a first liquid outlet, a first vapor inlet, and a first liquid inlet. The first heat exchanger defines a first warming zone and a first cooling zone. The first warming zone comprises a first cool fluid inlet and a first warm fluid outlet, while the first cooling zone defines a first warm fluid inlet and a first cool fluid outlet. The first liquid outlet of the first distillation column is in fluid flow communication with the first cool fluid inlet. The vapor-liquid separation vessel comprises a second feed inlet, a second overhead outlet, and a second bottoms outlet. The second feed inlet of the separation vessel is in fluid flow communication with the first warm fluid outlet of the first heat exchanger. The second heat exchanger comprises a second warming zone and a second cooling zone. The second cooling zone comprises a second warm fluid inlet and a second cool fluid outlet. The second warming zone comprises a first cool liquid inlet, a first warm vapor outlet, and a first warm liquid outlet. The second bottoms outlet of the separation vessel is in fluid flow communication with the first cool liquid inlet of the second heat exchanger. The second distillation column comprises a third feed inlet, a third bottoms outlet, and a third overhead outlet. The first warm liquid outlet of the second heat exchanger is in fluid flow communication with the third feed inlet of the second distillation column.

In a still further embodiment of the present invention, there is provided a liquefied natural gas (LNG) facility comprising a first distillation column, a first heat exchanger, a vapor-liquid separation vessel, and a second heat exchanger. The first distillation column comprises a first feed inlet, a first bottoms outlet, a first overhead outlet, a first liquid outlet, a first vapor inlet, and a first liquid inlet. The first heat exchanger defines a first warming zone and a first cooling zone. The first warming zone defines a first cool fluid inlet and a first warm fluid outlet, while the first cooling zone defines a first warm fluid inlet and a first cool fluid outlet. The first liquid outlet of the first distillation column is in fluid flow communication with the first cool fluid inlet of the first heat exchanger. The vapor-liquid separation vessel comprises a second feed inlet a second overhead outlet, and a second bottoms outlet. The second feed inlet of the separation vessel is in fluid flow communication with the first warm fluid outlet of the first heat exchanger. The second heat exchanger comprises a second warming zone and a second cooling zone. The second warming zone comprises a first cool liquid inlet, a first warm vapor outlet, and a first warm liquid outlet. The second bottoms outlet of the separation vessel is in fluid flow communication with the first cool liquid inlet of the second heat exchanger. At least one of the first warm vapor outlet of the second heat exchanger and the second overhead outlet of the vapor-liquid separation vessel is in fluid flow communication with the first vapor inlet of the first distillation column. The first warm liquid outlet of the second heat exchanger is in fluid flow communication with the first liquid inlet of the first distillation column. The first liquid outlet of the first distillation column is positioned at a higher vertical elevation than the first vapor inlet of the first distillation column and the first vapor inlet of the first distillation column is positioned at a higher vertical elevation than the first liquid inlet of the first distillation column.

BRIEF DESCRIPTION OF THE FIGURES

Certain embodiments of the present invention are described in detail below with reference to the enclosed figures, wherein.

DETAILED DESCRIPTION

The present invention can be implemented in a facility used to cool natural gas to its liquefaction temperature to thereby produce liquefied natural gas (LNG). The LNG facility generally employs one or more refrigerants to extract heat from the natural gas and then reject the heat to the environment. Numerous configurations of LNG systems exist, and the present invention may be implemented in many different types of LNG systems.

In one embodiment, the present invention can be implemented in a mixed refrigerant LNG system. Examples of mixed refrigerant processes can include, but are not limited to, a single refrigeration system using a mixed refrigerant, a propane pre-cooled mixed refrigerant system, and a dual mixed refrigerant system.

In another embodiment, the present invention is implemented in a cascade LNG system employing a cascade-type refrigeration process using one or more pure component refrigerants. The refrigerants utilized in cascade-type refrigeration processes can have successively lower boiling points in order to maximize heat removal from the natural gas stream being liquefied. Additionally, cascade-type refrigeration processes can include some level of heat integration. For example, a cascade-type refrigeration process can cool one or more refrigerants having a higher volatility via indirect heat exchange with one or more refrigerants having a lower volatility. In addition to cooling the natural gas stream via indirect heat exchange with one or more refrigerants, cascade and mixed-refrigerant LNG systems can employ one or more expansion cooling stages to simultaneously cool the LNG while reducing its pressure to near atmospheric pressure.

Figure 1:
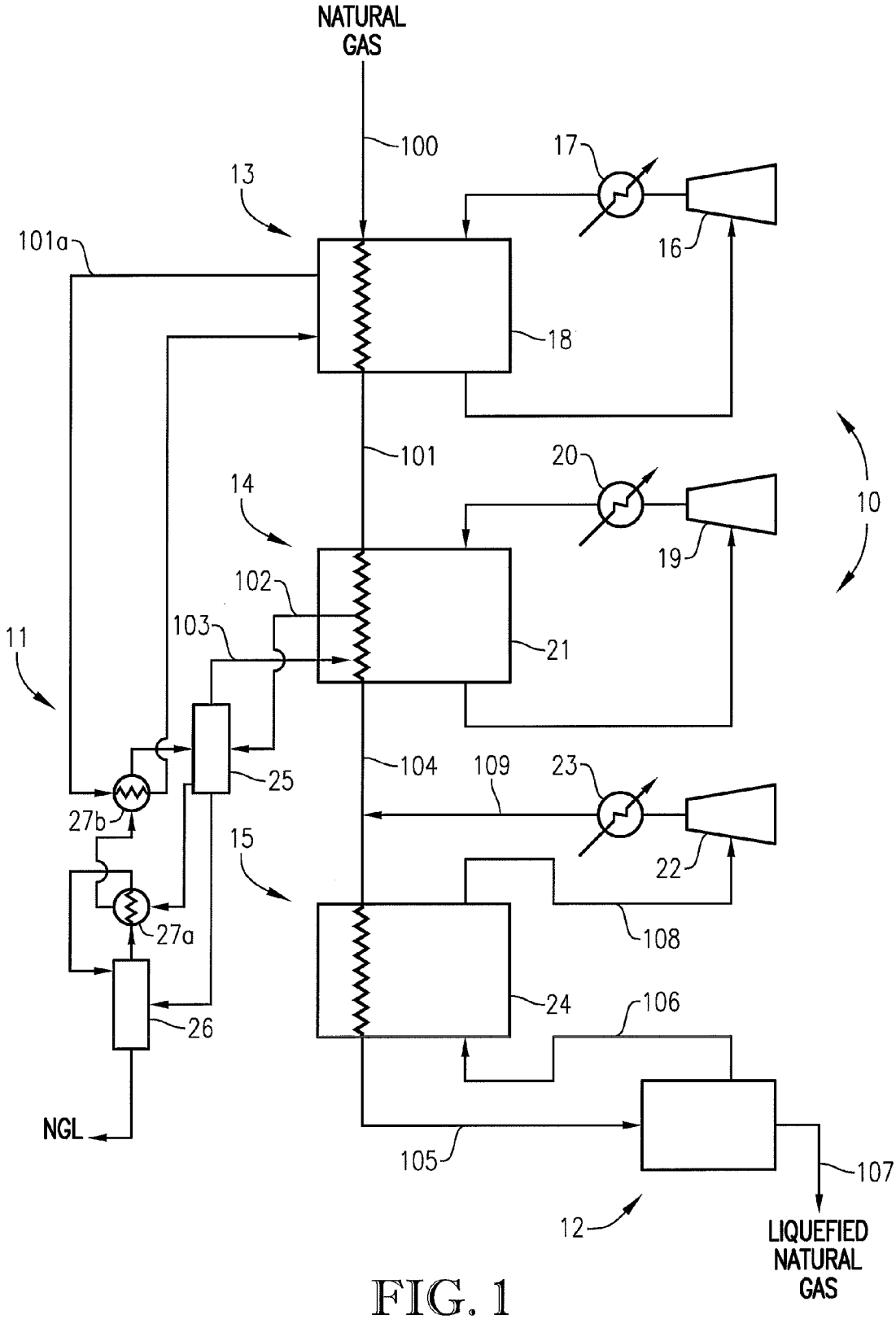
FIG. 1 is a simplified overview of a cascade-type LNG facility configured in accordance with one embodiment of the present invention.

FIG. 1 illustrates one embodiment of a simplified LNG facility employing an optimized heavies removal zone. The cascade LNG facility of FIG. 1 generally comprises a cascade cooling section 10, a heavies removal zone 11, and an expansion cooling section 12. Cascade cooling section 10 is depicted as comprising a first mechanical refrigeration cycle 13, a second mechanical refrigeration cycle 14, and a third mechanical refrigeration cycle 15. In general, first, second, and third refrigeration cycles 13, 14, 15 can be closed-loop refrigeration cycles, open-loop refrigeration cycles, or any combination thereof. In one embodiment of the present invention, first and second refrigeration cycles 13 and 14 can be closed-loop cycles, and third refrigeration cycle 15 can be an open-loop cycle that utilizes a refrigerant comprising at least a portion of the natural gas feed stream undergoing liquefaction.

In accordance with one embodiment of the present invention, first, second, and third refrigeration cycles 13, 14, 15 can employ respective first, second, and third refrigerants having successively lower boiling points. For example, the first, second, and third refrigerants can have mid-range boiling points at standard pressure (i.e., mid-range standard boiling points) within about 15° F. (8.3° C.), within about 10° F. (5.5° C.), or within 5° F. (2.8° C.) of the standard boiling points of propane, ethylene, and methane, respectively. At least one of the first and second refrigerants may be a pure component refrigerant that comprises propane, propylene, ethane, or ethylene. In one embodiment, the third refrigerant may be a mixed component refrigerant that comprises methane. In another embodiment, the third refrigerant may be pure component refrigerant comprising predominantly methane. In one embodiment, the first refrigerant can comprise at least about 75 mole percent, at least about 90 mole percent, at least 95 mole percent, or can consist of or consist essentially of propane, propylene, or mixtures thereof. The second refrigerant can comprise at least about 75 mole percent, at least about 90 mole percent, at least 95 mole percent, or can consist of or consist essentially of ethane, ethylene, or mixtures thereof. The third refrigerant can comprise at least about 75 mole percent, at least about 90 mole percent, at least 95 mole percent, or can consist of or consist essentially of methane.

As shown in FIG. 1, first refrigeration cycle 13 can comprise a first refrigerant compressor 16, a first cooler 17, and a first refrigerant chiller 18. First refrigerant compressor 16 can discharge a stream of compressed first refrigerant, which can subsequently be cooled and at least partially liquefied in cooler 17. The resulting refrigerant stream can then enter first refrigerant chiller 18, wherein at least a portion of the refrigerant stream can cool the incoming natural gas stream in conduit 100 via indirect heat exchange with the vaporizing first refrigerant. The gaseous refrigerant can exit first refrigerant chiller 18 and can then be routed to an inlet port of first refrigerant compressor 16 to be recirculated as previously described.

In one embodiment, before the incoming natural gas stream in conduit 100 is passed through the first refrigeration cycle 13, the natural gas stream may have passed through an impurities removal process to remove impurities including, for example, carbon dioxide ($CO_2$), nitrogen, sulfur-containing compounds (e.g., $H_2S$, COS, or $CS_2$), one or more heavy metals (e.g., Hg, Ar), and/or water, to thereby provide an impurities-lean natural gas stream, wherein at least a portion of the natural gas stream introduced into the first refrigeration cycle 13 via conduit 100 comprises at least a portion of the impurities-lean natural gas stream.

First refrigerant chiller 18 can comprise one or more cooling stages operable to reduce the temperature of the incoming natural gas stream in conduit 100 by about 40 to about 210° F. (about 22° C. to about 117° C.), by about 50° F. to about 190° F. (about 27° C. to about 106° C.), or by 75° F. to 150° F. (about 41° C. to about 84° C.). Typically, the natural gas entering first refrigerant chiller 18 via conduit 100 can have a temperature in the range of from about 0° F. to about 200° F. (about −18° C. to about 93° C.), from about 20° F. to about 180° F. (about −6° C. to about 82° C.), or from 50° F. to 165° F. (about 10° C. to about 74° C.), while the temperature of the cooled natural gas stream exiting first refrigerant chiller 18 can be in the range of from about −65° F. to about 0° F. (about −53° C. to about −18° C.), from about −50° F. to about −10° F. (about −45° C. to about −23° C., or from −35° F. to −15° F. (about −37° C. to about −26° C.). In general, the pressure of the natural gas stream in conduit 100 can be in the range of from about 100 pounds per square inch absolute (psia) to about 3,000 psia (about 689 kPa to about 20,684 kPa), from about 250 psia to about 1,000 psia (about 1,724 kPa to about 6,894 kPa), or from 400 psia to 800 psia (about 2,758 kPa to about 4,137 kPa). Because the pressure drop across first refrigerant chiller 18 can be less than about 100 psi (689 kPa), less than about 50 psi (344 kPa), or less than 25 psi (172 kPa), the cooled natural gas stream in conduit 101 can have substantially the same pressure as the natural gas stream in conduit 100.

As illustrated in FIG. 1, the cooled natural gas stream (also referred to herein as the "cooled predominantly methane stream") exiting first refrigeration cycle 13 via conduit 101 can then enter second refrigeration cycle 14, which can comprise a second refrigerant compressor 19, a second cooler 20, and a second refrigerant chiller 21. A compressed second refrigerant stream can be discharged from second refrigerant compressor 19 and can subsequently be cooled and at least partially liquefied in cooler 20 prior to entering second refrigerant chiller 21. Second refrigerant chiller 21 can employ a plurality of cooling stages to progressively reduce the temperature of the cooled predominantly methane stream in conduit 101 by about 50 to about 180° F. (about 27° C. to about 100° C.), about 65 to about 150° F. (about 36° C. to about 83° C.), or 95 to 125° F. (about 52° C. to about 70° C.) via indirect heat exchange with the vaporizing second refrigerant. As shown in FIG. 1, the vaporized second refrigerant can then be returned to an inlet port of second refrigerant compressor 19 prior to being recirculated in second refrigeration cycle 14, as previously described.

The natural gas feed stream in conduit 100 will usually contain ethane and heavier components ($C_2$+), which can result in the formation of a $C_2$+ rich liquid phase in one or more of the cooling stages of second refrigeration cycle 14. In order to remove the undesirable heavies material from the predominantly methane stream prior to complete liquefaction, at least a portion of the natural gas stream passing through second refrigerant chiller 21 can be withdrawn via conduit 102 and processed in heavies removal zone 11, as shown in FIG. 1. The at least a portion of the natural gas stream in conduit 102 can have a temperature in the range of from about −160 to about −50° F. (about −107° C. to about −45° C.), about −140 to about −65° F. (about −95° C. to about −54° C.), or −115 to −85° F. (about −82° C. to about −65° C.) and a pressure that is within about 5 percent, about 10 percent, or 15 percent of the pressure of the natural gas feed stream in conduit 100.

Heavies removal zone 11 can comprise one or more gas-liquid separators operable to remove at least a portion of the heavies material from the predominantly methane natural gas stream. In one embodiment, as depicted in FIG. 1, heavies removal zone 11 comprises a first distillation column 25 and a second distillation column 26. First distillation column 25, also referred to herein as the "heavies removal column," functions primarily to remove the bulk of the heavies material, especially components with molecular weights greater than hexane (i.e., $C_6$+ material) and aromatics such as benzene, toluene, and xylene, which can freeze in downstream processing equipment, such as, for example, at least one of second refrigerant chiller 21 and third refrigerant chiller 24 illustrated in FIG. 1. First distillation column 25 and/or second distillation column 26 can include one or more internal mass transfer surfaces in the form of trays, random packing, structured packing, or any combination thereof. In one embodiment, first distillation column 25 and/or second distillation column 26 can comprise trays and/or packing. First distillation column 25 and/or second distillation column 26 may have at least about 2 theoretical stages of separation, at least about 3 theoretical stages of separation, or at least about 4 theoretical stages of separation. First distillation column 25 and/or second distillation column 26 may have at most about 25 theoretical stages of separation, at most about 20 theoretical stages of separation, or at most about 15 theoretical stages of separation, or at most about 10 theoretical stages of separation. First distillation column 25 and/or second distillation column 26 may have from about 2 to about 20 theoretical stages, or from about 2 to about 10 theoretical stages, or from 4 to 8 theoretical stages.

The process for liquefying the natural gas stream (such as stream in conduit 100 in FIG. 1) comprises a heavies removal process that may be integrated with the refrigeration process as illustrated in FIG. 1 or may be carried out upstream of the refrigeration process (not illustrated). The heavies removal process may use first distillation column 25 and/or second distillation column 26 to separate components of the natural gas stream (such as stream in conduit 102).

The separation in first distillation column 25 may provide an overhead stream (also called "first predominantly vapor stream") exiting first distillation column 25 via conduit 103. The overhead stream in conduit 103 is enriched in methane and leaner in heavies content compared to the natural gas feed (in conduit 102) to first distillation unit 25. The overhead stream exiting first distillation column 25 via conduit 103 can comprise at least about 65 mole percent, at least about 75 mole percent, at least about 85 mole percent, at least about 95 mole percent, or at least 99 mole percent methane. Typically, the concentration of $C_6$+ material in the overhead stream exiting first distillation column 25 via conduit 103 can be less than about 0.1 weight percent, less than about 0.05 weight percent, less than about 0.01 weight percent, or less than 0.005 weight percent, based on the total weight of the stream. Generally, first distillation column 25 can operate with an overhead temperature in the range of from about −200° F. to about −75° F. (about −129° C. to about −59° C.), from about −185° F. to about −90° F. (about −121° C. to about −67° C.), or from about −170° F. to about −110° F. (about −112° C. to about −78° C.) and an overhead pressure in the range of from about 20 bars gauge (barg) to about 70 barg (about 2,100 kPa to about 7,100 kPa), from about 25 barg to about 65 barg (about 2,600 kPa to about 6,600 kPa), or from 35 barg to 60 barg (about 3,600 kPa to about 6,100 kPa).

The separation in first distillation column 25 may also provide one ore more heavies-rich streams lean in methane, such as a first predominantly liquid stream exiting first distillation column 25 which is directed to first heat exchanger 27*a* and another predominantly liquid stream exiting first distillation column 25 which is directed to second distillation column 26 as illustrated in FIG. 1. The other predominantly liquid stream exiting first distillation column 25 which is directed to second distillation column 26 may be called "heavies-rich stream" and/or may be referred to as "predominantly liquid bottoms stream" especially when it is withdrawn neat or at the bottom of first distillation column 25.

As illustrated in FIG. 1, the predominantly liquid bottoms stream exiting the bottom of first distillation column 25 may enter second distillation column 26 for separation of its components. The predominantly liquid bottoms stream may have a temperature in the range of from about −20° F. to about −100° F. (from about −29° C. to about −73° C.), from about −35° F. to about −85° F. (from about −37° C. to about −65° C.), or from −45° F. to −65° F. (from −43° C. to −54° C.). Second distillation column 26, also called "NGL recovery column," concentrates residual heavy hydrocarbon components into an NGL product stream. Examples of typical hydrocarbon components included in NGL streams can include, for example, ethane, propane, butane isomers, pentane isomers, and $C_6$+ material. The specific composition of the NGL stream can depend on specific NGL and/or LNG product specifications. Second distillation column 26 may also provide an overhead stream, also called "second predominately vapor stream", which can be leaner in residual heavy hydrocarbon components than the NGL product stream. Accordingly, the operating conditions (e.g., overhead temperature and pressure) of second distillation column 26 can vary according to the degree of NGL recovery desired. In one embodiment, second distillation column 26 can have an overhead temperature in the range of from about −50° F. to about 120° F. (from about −45° C. to about 49° C.), from about −25° F. to about 75° F. (from about −32° C. to about 24° C.), or from −10° F. to 50° F. (from −23° C. to 10° C.), and an overhead pressure in the range of from about 5 barg to about 50 barg (from about 600 kPa to about 5,100 kPa), from about 10 barg to about 40 barg (from about 1,100 kPa to about 4,100 kPa), or from 15 barg to 30 barg (from 1,600 kPa to 3,100 kPa). In one embodiment, the NGL product stream exiting heavies removal zone 11 can be subjected to further fractionation (not shown) in order to obtain one or more substantially pure component streams. Often, NGL and/or the substantially pure product streams derived therefrom can be desirable blendstocks for gasoline and other fuels.

Generally, at least one of first or second distillation columns 25, 26 can comprise a reboiler. In one embodiment, the reboiler employed by first distillation column 25 can comprise at least two separate heat exchangers. As depicted in the embodiment illustrated in FIG. 1, a liquid stream withdrawn from first distillation column 25 can be sequentially heated in a first heat exchanger 27*a* and a second heat exchanger 27*b* to thereby produce a heated fluid stream, which can then be reintroduced into first distillation column 25 as a reboiled fluid stream. The heat exchange medium streams employed by first and second heat exchangers 27*a,b* can comprise any process stream. In one embodiment, at least one of first and second heat exchangers 27*a,b* can employ at least a portion of the natural gas feed stream as a heat exchange medium. For example, as illustrated in FIG. 1, a portion of the natural stream in conduit 101*a* can serve as a heat exchange medium for second heat exchanger 27*b*. In accordance with one embodiment, the portion of the natural gas feed stream which is employed as a heat exchange medium in at least one of first and second heat exchangers 27*a,b* has not previously passed through first distillation column 25. In another embodiment, at least one of first and second heat exchangers 27*a,b* can use at least a portion of the second predominately vapor stream (also called the overhead vapor stream) withdrawn from second distillation column 26 as a heat exchange medium. In the embodiment illustrated in FIG. 1, second heat exchanger 27*b* utilizes a portion of the natural gas feed stream withdrawn from propane refrigeration cycle 13 in conduit 101*a* as a heat exchange medium, while the heat exchange medium employed in first heat exchanger 27*a* comprises a portion of the overhead stream withdrawn from second distillation column 26. In accordance with one embodiment, first heat exchanger 27*a* can act as a condenser for at least a portion of the second predominately vapor stream (or overhead stream) withdrawn from second distillation column 26, as depicted in FIG. 1.

The second predominately vapor stream exiting the second distillation column 26 may be directed to first heat exchanger 27*a* to be cooled (in some embodiments, at least partially condensed) via indirect heat exchange with the first predominantly liquid stream exiting first distillation column 25 which can also be directed to first heat exchanger 27*a*. The first predominantly liquid stream can then be heated while passing through first heat exchanger 27*a* to form a first heated stream. The first heated stream may be routed directly or indirectly, in part (not illustrated) or in entirety (as shown) to second heat exchanger 27*a*, where it can be further heated to thereby form a second heated stream. This second heated stream may be routed in part (not illustrated) or in entirety (as shown) to first distillation column 25 (as shown) or to second distillation column 26 (not illustrated).

Heavies removal zone 11 can also comprise a vapor-liquid separator (not shown) to separate at least a portion of a reboiled fluid stream (such as a reboiled vapor fraction of first heated stream and/or second heated stream) prior to its reintroduction into first distillation column 25. For example, the vapor-liquid separator can receive a heated stream (e.g., the first and/or second heated stream) from at least one of first or second heat exchangers 27*a,b*. Subsequently, the resulting vapor and/or liquid fractions withdrawn from the vapor-liquid separator can be utilized as the reboiled fluid stream. Typically, the vapor-liquid separator can comprise a single-stage flash vessel and can be disposed upstream of first heat exchanger 27*a*, between first and second heat exchangers 27*a,b*, or downstream of second heat exchanger 27*b*. In another embodiment, two or more vapor-liquid separators may be used. One embodiment of a heavies removal zone employing a two-exchanger reboiler system including a vapor-liquid separation vessel will be described in more detail shortly with reference to FIG. 2.

Referring back to FIG. 1, the first predominately vapor stream which can be depleted in heavies and can comprise predominantly methane (also called "heavies-depleted predominantly methane stream") can be withdrawn from first distillation column 25 via conduit 103 and can be routed back to second refrigeration cycle 14. The heavies-depleted predominantly methane stream in conduit 103 can have a temperature in the range of from about −140° F. to about −50° F. (from about −96° C. to about −45° C.), from about −125° F. to about −60° F. (from about −87° C. to about −51° C.), or from −110° F. to −75° F. (from about −79° C. to about −59° C.) and a pressure in the range of from about 200 psia to about 1,200 psia (from about 1,380 kPa to about 8,275 kPa), from about 350 psia to about 850 psia (from about 2,410 kPa to about 5,860 kPa), or from 500 psia to 700 psia (from 3,445 kPa to 4,825 kPa). As shown in FIG. 1, the heavies-depleted predominantly methane stream in conduit 103 can subsequently be further cooled via second refrigerant chiller 21.

In one embodiment, the stream exiting second refrigerant chiller 21 via conduit 104 (also called the "pressurized LNG-bearing stream") can be completely liquefied and can have a temperature in the range of from about −205° F. to about −70° F. (from about −132° C. to about −57° C.), from about −175° F. to about −95° F. (from about −115° C. to about −70° C.), or from −140° F. to −125° F. (from −95° C. to −87° C.). Generally, the stream in conduit 104 can be at approximately the same pressure the natural gas stream entering the LNG facility in conduit 100.

As illustrated in FIG. 1, the pressurized LNG-bearing stream in conduit 104 can combine with a yet-to-be-discussed stream in conduit 109 prior to entering third refrigeration cycle 15, which is depicted as generally comprising a third refrigerant compressor 22, a cooler 23, and a third refrigerant chiller 24. A compressed third refrigerant stream can be discharged from third refrigerant compressor 22 and can enter cooler 23, wherein the third refrigerant stream can cooled and at least partially liquefied prior to entering third refrigerant chiller 24. Third refrigerant chiller 24 can comprise one or more cooling stages operable to subcool the pressurized predominantly methane stream via indirect heat exchange with the vaporizing refrigerant. In one embodiment, the temperature of the pressurized LNG-bearing stream can be reduced by about 2° F. to about 60° F. (by about 1.1° C. to about 33° C.), by about 5° F. to about 50° F. (by about 2.8° C. to about 28° C.), or by 10° F. to 40° F. (by 5.5° C. to 22° C.) in third refrigerant chiller 24. In general, the temperature of the pressurized LNG-bearing stream exiting third refrigerant chiller 24 via conduit 105 can be in the range of from about −275° F. to about −75° F. (from about −170° C. to about −59° C.), from about −225° F. to about −100° F. (from about −142° C. to about −73° C.), or from −200° F. to −125° F. (from −129° C. to −87° C.).

As shown in FIG. 1, the pressurized LNG-bearing stream in conduit 105 can be then routed to expansion cooling section 12, wherein the stream is subcooled via sequential pressure reduction to near atmospheric pressure by passage through one or more expansion stages. In one embodiment, each expansion stage can reduce the temperature of the LNG-bearing stream by about 10 to about 60° F. (by about 5.5° C. to about 33° C.), by about 15 to about 50° F. (by about 8.3° C. to about 28° C.), or by 20 to 40° F. (by 11° C. to 22° C.). Each expansion stage comprises one or more expanders, which reduce the pressure of the liquefied stream to thereby evaporate or flash a portion thereof. Examples of suitable expanders can include, but are not limited to, Joule-Thompson valves, venturi nozzles, and turboexpanders. Expansion section 12 can employ any number of expansion stages and one or more expansion stages may be integrated with one or more cooling stages of third refrigerant chiller 24. In one embodiment of the present invention, expansion section 12 can reduce the pressure of the LNG-bearing stream in conduit 105 by about 75 psi to about 450 psi (by about 517 kPa to about 3,100 kPa), by about 125 psi to about 300 psi (by about 860 kPa to about 2,070 kPa), or by 150 psi to 225 psi (by 1,030 kPa to 1,550 kPa).

Each expansion stage may additionally employ one or more vapor-liquid separators operable to separate the vapor phase (i.e., the flash gas stream) from the cooled liquid stream. As previously discussed, third refrigeration cycle 15 can comprise an open-loop refrigeration cycle, a closed-loop refrigeration cycle, or any combination thereof. When third refrigeration cycle 15 comprises a closed-loop refrigeration cycle, the flash gas stream can be used as fuel within the facility or routed downstream for storage, further processing, and/or disposal. When third refrigeration cycle 15 comprises an open-loop refrigeration cycle, at least a portion of the flash gas stream exiting expansion section 12 can be used as a refrigerant to cool at least a portion of the natural gas stream in conduit 104. Generally, when third refrigerant cycle 15 comprises an open-loop cycle, the third refrigerant can comprise at least 50 weight percent, at least about 75 weight percent, or at least 90 weight percent of flash gas from expansion section 12, based on the total weight of the stream. As illustrated in FIG. 1, the flash gas exiting expansion section 12 via conduit 106 can enter third refrigerant chiller 24, where at least a portion of the flash gas can be used as a refrigerant. Generally, the third refrigerant comprising or consisting of flash gas exiting expansion section 12 can enter third refrigerant chiller 24 via conduit 106 and can cool at least a portion of the natural gas stream entering third refrigerant chiller 24 via conduit 104. The resulting warmed refrigerant stream can then exit third refrigerant chiller 24 via conduit 108 and can thereafter be routed to an inlet port of third refrigerant compressor 22. As shown in FIG. 1, third refrigerant compressor 22 discharges a stream of compressed third refrigerant, which is thereafter cooled in cooler 23. The resulting cooled refrigerant stream (which can comprise predominantly methane) in conduit 109 can then combine with the natural gas stream in conduit 104 prior to entering third refrigerant chiller 24, as previously discussed.

As shown in FIG. 1, the liquid stream exiting expansion section 12 via conduit 107 comprises LNG. In one embodiment, the LNG in conduit 107 can have a temperature in the range of from about −200° F. to about −300° F. (from about −129° C. to about −185° C.), from about −225° F. to about −275° F. (from about −143° C. to about −171° C.), or from −240° F. to −260° F. (from about −151° C. to about −162° C.), and a pressure in the range of from about 0 psia to about 40 psia (from about 0 kPa to about 276 kPa), from about 5 psia to about 25 psia (from about 34 kPa to about 172 kPa), from 10 psia to 20 psia (from 69 kPa to 138 kPa), or about atmospheric (100-102 kPa). The LNG in conduit 107 can have at least 85 percent by volume (vol. %) of methane, or at least 87.5 vol. % methane, or at least 90 vol. % methane, or at least 92 vol. % methane, or at least 95 vol. % methane, or at least 97 vol. % methane. In some embodiments, the LNG in conduit 107 can have at most 15 vol. % ethane, or at most 10 vol. % ethane, or at most 7 vol. % ethane, or at most 5 vol. % ethane. In yet additional or alternate embodiments, the LNG in conduit 107 can have at most 2 vol. % $C_3^+$ material, or at most 1.5 vol. % $C_3^+$ material, or at most 1 vol. % $C_3^+$ material, or at most 0.5 vol. % $C_3^+$ material. According to one embodiment, the LNG in conduit 107 can have at least 90 vol. % methane, at most 10 vol. % ethane, and at most 1 vol. % $C_3^+$ material. The LNG in conduit 107 may have same values in percent by mole (mol. %) for methane, ethane and $C_3^+$ material The LNG in conduit 107 can subsequently be routed to storage and/or shipped to another location via pipeline, ocean-going vessel, truck, or any other suitable transportation means. In one embodiment, at least a portion of the LNG can be subsequently vaporized for pipeline transportation or for use in applications requiring vapor-phase natural gas.

Heavies removal zone 11 can be capable of removing at least a portion of one or more undesirable components from the natural gas stream. In general, the ability of heavies removal zone 11 to separate out an undesirable component, component X, can be expressed as the "component X separation efficiency" of heavies removal zone, wherein the term "component X separation efficiency" can be determined according to the following formula: 1−(total volume of component X exiting heavies removal zone 11 via conduit 103/total volume of component X entering heavies removal zone 11 via conduit 102), expressed as a percentage. In one embodiment, heavies removal zone 11 can have a $C_2$+ separation efficiency of at least about 40% or at least about 50%, or at least 60%. In another embodiment, heavies removal zone 11 can have a $C_5$+ separation efficiency of at least about 50%, or at least about 60%, or at least about 70%, or at least about 80%.

Figure 2:
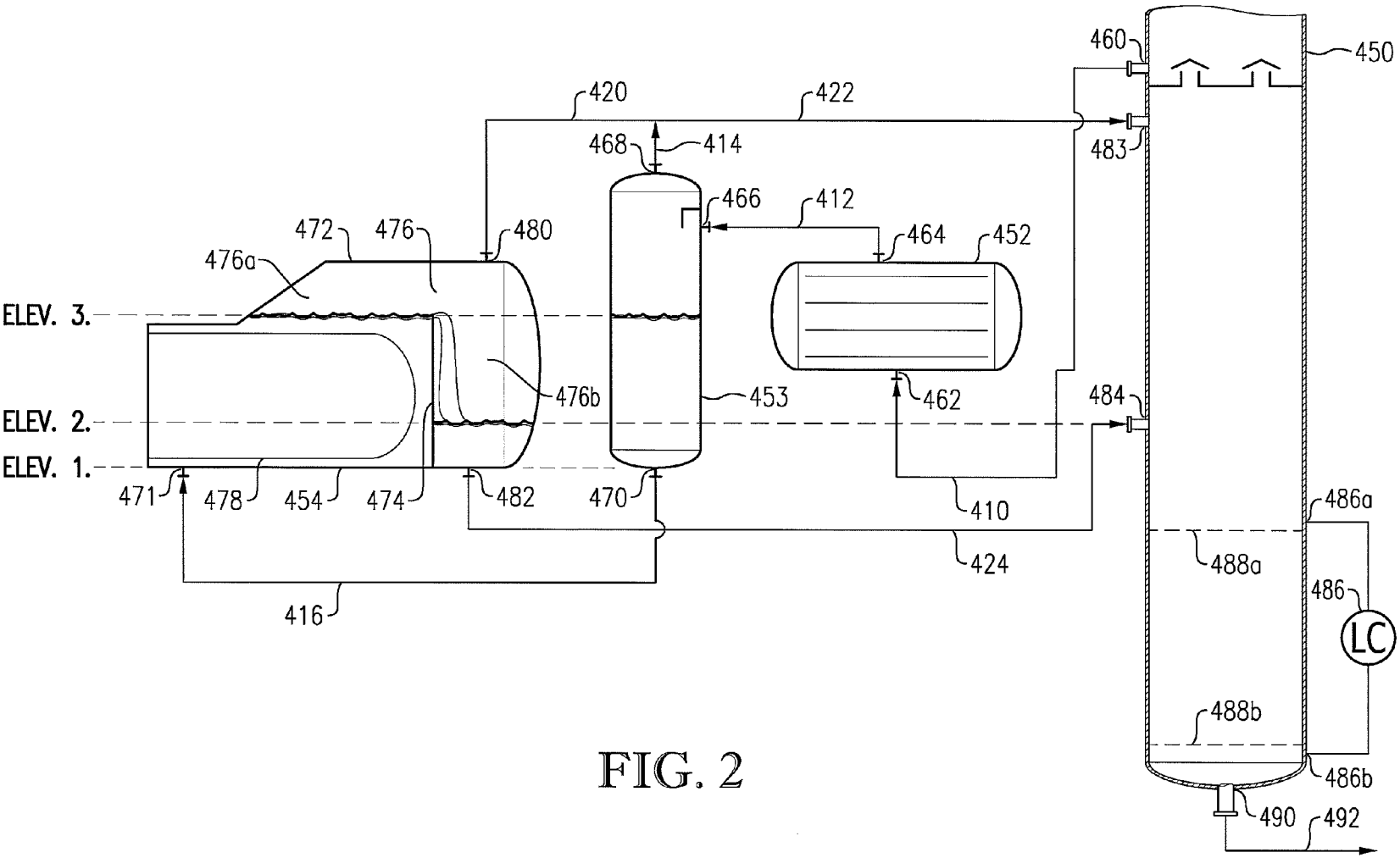
FIG. 2 is a schematic diagram illustrating a portion of a heavies removal zone according to one embodiment of the present invention.

Referring now to FIG. 2, a portion of one embodiment of a specific configuration of a heavies removal zone that can be employed in an LNG facility as described previously with respect to FIG. 1 is presented. While the heavies removal zone illustrated in FIG. 2 is described below as being integrated in a cascade-type LNG facility, it should be understood that the system described with respect to FIG. 2 can also be employed in a different type of LNG facility, including, for example, an LNG facility employing a mixed refrigerant. In addition, the system described with respect to FIG. 2 can be employed in an LNG facility employing any number of refrigeration cycles, including, for example, at least 2 or at least 3 refrigeration cycles.

In an additionally or alternative embodiment, the heavies removal process which is carried out in heavies removal zone 11 on at least a portion of a natural gas stream (e.g., stream in conduit 102 in FIG. 1) may be carried out in between any two sequential refrigeration cycles, such as between first refrigeration cycle 13 and second refrigeration cycle 14. In another embodiment, the heavies removal process in heavies removal zone 11 may be carried out during a refrigeration cycle, such as during first refrigeration cycle 13 or during second refrigeration cycle 14, as illustrated in FIG. 1. In a further embodiment, the heavies removal process in heavies removal zone 11 may be carried out before any refrigeration cycle, such as upstream of the first refrigeration cycle 13 of FIG. 1. According to some embodiments, a portion of the natural gas or its entirety in conduit 100 or in conduit 101 or in conduit 104 may serve as one natural gas feed to the first distillation column 25.

The heavies removal zone illustrated in FIG. 2 generally comprises a first distillation column 450, a first heat exchanger 452, a vapor-liquid separator 453, and a second heat exchanger 454. For the sake of clarity, only the lower portion of first distillation column 450 is depicted in FIG. 2. In one embodiment (not shown), at least a portion of a natural gas stream can be fed in an upper portion of first distillation column 450. In some embodiments, a natural gas stream may have been cooled in an upstream refrigeration cycle (that is to say, upstream of the first distillation column 450) to thereby provide a cooled natural gas stream, wherein at least a portion of the natural gas stream introduced into the first distillation column 450 comprises at least a portion of the cooled natural gas stream.

In an additional or alternative embodiment, a natural gas stream may have passed through an impurities removal process, for example to remove impurities like carbon dioxide ($CO_2$), nitrogen, sulfur-containing compounds ($H_2S$, COS, or $CS_2$), one or more heavy metals (Hg, Ar), and/or water, to thereby provide an impurities-lean natural gas stream, wherein at least a portion of the natural gas stream introduced into the first distillation column 450 comprises at least a portion of the impurities-lean natural gas stream. In some embodiments, the heavies removal zone illustrated in FIG. 2 can be located downstream of an impurities removal zone (not illustrated) so that the natural gas stream (or a portion thereof) feeding first distillation column 450 can be lean in one or more impurities such as, for example, $CO_2$, $N_2$, S, $H_2O$, heavy metal(s). In some embodiments, the heavies removal zone illustrated in FIG. 2 can be located downstream of a refrigeration cycle (not shown) and the refrigeration cycle can be downstream of an impurities removal zone (not shown), so that the natural gas stream feed to first distillation column 450 can be cooled and can be lean in one or more impurities such as water, $CO_2$, $N_2$, S, $H_2O$, heavy metal(s).

As shown in FIG. 2, a liquid stream can be withdrawn from a liquid outlet 460 of first distillation column 450. The liquid stream can be withdrawn at any suitable location of first distillation column. In one embodiment, the liquid stream can be withdrawn from a tray, such as, for example, a total draw tray or a chimney tray located in an upper zone of the lower portion of first distillation column 450, as depicted in FIG. 2. The withdrawn liquid stream in conduit 410 (also called "first predominately liquid stream") can then be introduced into a fluid inlet 462 of first heat exchanger 452, wherein the stream can be heated and at least partially vaporized. Heat exchanger 452 can be selected from a variety of different types of heat exchangers. In one embodiment, heat exchanger 452 can be a shell-and-tube exchanger. Examples of suitable shell-and-tube exchangers can include single pass straight tube exchangers, multi-pass straight tube exchangers, U-tube exchangers, twisted-tube bundle exchangers, kettle-type shell-and-tube exchangers, and combinations thereof. In some embodiments, heat exchanger 452 can be a kettle-type shell-and-tube exchanger. In alternate or additional embodiments, heat exchanger 452 is not a brazed-aluminum heat exchanger. Typically, the liquid stream withdrawn from first distillation column 450 via outlet 460 can be introduced into the shell-side of first heat exchanger 452, while the heat exchange medium (not shown) can pass through the heat exchange tubes. Alternatively, the configuration of first heat exchanger 452 can be reversed so that the liquid stream withdrawn from first distillation column can be introduced into the heat exchange tubes, while the heat exchange medium, not shown, can be introduced into the shell-side of first heat exchanger 452. Although not illustrated in FIG. 2, the heat exchange medium in first heat exchanger 452 may comprise an overhead vapor stream of a second distillation unit. As it will be explained later in FIG. 3*c*, 3*c*, 4*b*, 4*c*, the second distillation unit may be used to further separate heavies from a heavies-enriched stream such as at least a portion of second heated liquid stream exiting second heat exchanger 454 in conduit 424 and/or at least a portion of a bottoms stream exiting first column 450 in conduit 492.

A heated two-phase stream in conduit 412 can be withdrawn from a fluid outlet 464 of first heat exchanger 452, and, thereafter, can be introduced via conduit 412 into a fluid inlet 466 of vapor-liquid separation vessel 453, as shown in FIG. 2. In one embodiment, at least a portion of conduit 412 can be positioned at an angle of at least about 10°, at least about 25°, or at least 25° with respect to the horizontal in order to minimize unstable flow conditions in the fluid stream flowing in conduit 412 and entering vapor-liquid separation vessel 453. In one embodiment, the heated two-phase stream fed to first heat exchanger 452 via conduit 412 can be separated into liquid and vapor phases in vapor-liquid separation vessel 453. The immediate separation of the first heated two-phase stream in separation vessel 453 can, in one embodiment, minimize the length of piping through which two-phase flow occurs and thus minimize the incidence of slug flow, which would lead to unstable operation of the system depicted in FIG. 2. To further minimize occurrence of slug flow in conduit 412 through which first heated two-phase stream passes from first heat exchanger 452 to vapor-liquid separation vessel 453, fluid outlet 464 of first heat exchanger 452 and fluid inlet 466 of separation vessel 453 can be in close proximity to each other in order for the length of conduit 412 (through which first heated two-phase stream flows) to be as short as possible.

A separated first heated vapor fraction of the first heated stream (which can be a predominantly vapor stream) can be withdrawn via an upper overhead vapor outlet 468 of vapor-liquid separator 453 and routed into conduit 414, while a separated first heated liquid fraction of the first heated stream (which can be a predominantly liquid stream) can be withdrawn from a lower bottoms outlet 470 of vapor-liquid separation vessel 453 and routed into conduit 416. In one embodiment, at least a portion of the first heated vapor fraction in conduit 414 can be routed back to first distillation column 450 as a reboiled vapor fraction without being routed to or heated in second heat exchanger 454, as illustrated in FIG. 2. In one embodiment, the first heated liquid fraction in conduit 416 can subsequently be routed into a fluid inlet 471 of second heat exchanger 454. Fluid inlet 471 may be positioned, although not necessarily, at or near the bottom of the shell 472 of the second heat exchanger 454. Fluid inlet 471 may be alternatively positioned on a side wall of shell 472 of the second heat exchanger 454. At least a portion of the first heated stream in conduit 412 is not reintroduced into the first distillation column 450 between the first and second heat exchangers 452, 454. That is to say, at least some of the first heated stream components flow from fluid outlet 464 of first heat exchanger 452, through conduit 412, through separator 453, through conduit 416 to fluid inlet 471 of second heat exchanger 454 without being routed back to first distillation column 450.

In one embodiment, second heat exchanger 454 can be a shell-and-tube heat exchanger. Examples of suitable shell-and-tube exchangers can include single pass straight tube exchangers, multi-pass straight tube exchangers, U-tube exchangers, twisted-tube bundle exchangers, kettle-type exchangers, and combinations thereof. In one embodiment, second heat exchanger 454 is not a brazed aluminum heat exchanger. A shell-and-tube heat exchanger employed in exchanger 452 and/or 454 may offer greater flexibility in operating margins and may further eliminate the need for temperature differential controls which are generally needed for a brazed aluminum heat exchanger. In one embodiment depicted in FIG. 2, second heat exchanger 454 can be a kettle-type shell-and-tube heat exchanger. According to the embodiment shown in FIG. 2, kettle-type shell-and-tube second heat exchanger 454 comprises a shell 472, a tube bundle 478, and an internal weir 474. Internal weir 474 extends from the bottom of shell 472 part way towards the top of shell 472, thereby defining a fluid flow passageway 476 between the uppermost edge of weir 474 and the top of shell 472.

Shell 472 of second heat exchanger 454 defines an internal volume in second heat exchanger 454, wherein internal weir 474 divides the internal volume defined by shell 472 into a heating zone 476*a* (also called a "first side") where tube bundle 178 allows for indirect heat transfer and a separating zone 476*b* (also called a "second side").

It should be understood that, although described above with respect to a kettle-type shell-and-tube heat exchanger, second heat exchanger 454 can also be a plate-fin heat exchanger, or any other suitable type of heat exchanger. Similarly, although first heat exchanger 452 is described above as a shell-and-tube heat exchanger, first heat exchanger 452 can be a plate-fin heat exchanger, or any other suitable type of heat exchanger. Accordingly, depending on the type of exchanger employed, first and/or second heat exchangers 452, 454 can include separate heated vapor and liquid outlets or can comprise a single heated fluid outlet for withdrawing a two-phase fluid stream. In one embodiment, at least one of first and second heat exchangers 452, 454 is not a brazed-aluminum heat exchanger, and/or at least one of first and second heat exchangers 452, 454 is a shell-and-tube heat exchanger.

As shown in FIG. 2, the liquid stream in conduit 416 can be introduced into heating zone 476*a* (also called first side of second heat exchanger 454) of second heat exchanger 454, wherein the liquid can be at least partially vaporized by indirect heat exchange with a heat exchange medium (not shown) flowing through tube bundle 478. The cold liquid stream in conduit 416 can generally be introduced into heating zone 476*a* at or near the bottom of second heat exchanger 454 to ensure that the cold stream entering heating zone 476*a* comes into contact with the heated tube bundle 478 for appropriate indirect heat exchange before exiting heating zone 476*a*. For that purpose, fluid inlet 471 may be positioned at or near the bottom of the shell 472 on the first side of the second heat exchanger 454. Alternatively, fluid inlet 471 may be positioned on a side wall of shell 472 so that the cold liquid stream in conduit 416 may be introduced into heating zone 476*a* through side wall of shell 472. Fluid inlet 471 may be positioned at a location as far away as possible from the bottom location of weir 474 (such as on a side wall of heating zone 476*a* opposite to weir 474) to maximize contact time of the liquid feed with tube bundle 478. Fluid inlet 471 may be configured to direct the liquid stream from conduit 416 entering exchanger 454 into a liquid pool in heating zone 476*a* towards tube bundle 478. In this manner, it is unlikely that the liquid feed entering exchanger 454 (from conduit 416) would bypass tube bundle 478 and flow directly over weir 474.

The first heated liquid fraction in conduit 416 is predominantly liquid. In some embodiments, the first heated liquid fraction in conduit 416 may comprise less than 10 percent by volume (vol. %) vapor or less than 5 vol. % vapor, or may consist essentially of liquid. The presence of vapor in first heated liquid fraction fed to second heat exchanger 454 may create gas pockets into the liquid pool of heating zone 476*a* and thus may reduce the efficiency of heat transfer in heating zone 476*a* of second heat exchanger 454.

The heat exchange medium in second heat exchanger 454 flowing through tube bundle 478 present in heating zone 476*a* may comprise at least a portion of a natural gas stream. The heating of the liquid stream entered via conduit 416 is accomplished in heating zone 476*a* of second heat exchanger 454 via indirect heat exchange with at least a portion of a natural gas stream withdrawn from a location upstream of first distillation column 450. In other words, the portion of a natural gas stream which is used as heat exchange medium in second heat exchanger 454 has not passed through first distillation column 450 prior to entering second heat exchanger 454.

The combined vapor and liquid phases in the shell 472 of the second heat exchanger 454 can then exit heating zone 476*a* by flowing through fluid passageway 474 (i.e., over the uppermost edge of internal weir 474) and into separating zone 476*b*. As depicted in FIG. 2, the liquid phase may pass by overflow over the uppermost edge of internal weir 474 from heating zone 476*a* (or first side) into separating zone 476*b* (or second side). The vapor phase can ascend toward the top of separating zone 476*b* and can then be withdrawn via vapor outlet 480. As shown in FIG. 2, the liquid phase in separating zone 476*b* can be withdrawn from second heat exchanger 454 via a warm liquid outlet 482 to form a second heated liquid fraction (which is predominately liquid) into conduit 424. Liquid outlet 482 can generally be positioned, although not necessarily, at or near the bottom of the shell 472 on the second side of the second heat exchanger 454. The vapor phase in second heat exchanger 454 can be withdrawn through vapor outlet 480 to form a second heated vapor fraction (which is predominately vapor) in conduit 420. Vapor outlet 480 can generally be positioned, although not necessarily, at or near the top of the shell 472 on the first or second side of the second heat exchanger 454. Subsequently, the second heated predominantly vapor stream in conduit 420 can optionally be combined with the vapor stream in conduit 414 exiting vapor-liquid separator 453 before being routed via conduit 422 to first distillation column 450, wherein the combined stream can be employed as a reboiled vapor fraction entering first distillation column 450 via vapor inlet 483. Vapor inlet 483 of first distillation column 450 can be operable to receive a reboiled vapor fraction from first and/or second heat exchangers 452, 454. In one embodiment, vapor inlet 483 is located at a lower elevation than liquid outlet 460 of first distillation column 450.

Second heat exchanger 454 and vapor-liquid separator 453 can be in fluid flow communication in such a manner that the liquid level in vapor-liquid separator 453 can be self-regulating as it can be set hydraulically by the height of weir 474 in second heat exchanger 454. In this manner, the level is independent of varying flow rates and compositions of the feed of vapor-liquid separator 453 (first heated stream in conduit 412) as well as duty requirement of second heat exchanger 454, and there is no need to use a liquid level controller for vapor-liquid separator 453.

Referring again to FIG. 2, at least some components of the second heated liquid fraction withdrawn from second heat exchanger 454 in conduit 424 can be routed directly or indirectly from second heat exchanger 454 to a second distillation column (not shown). In one embodiment, at least some components of the second heated liquid fraction (e.g., at least a portion of the second heated stream) can be routed directly via conduit 424 from second heat exchanger 454 to a second distillation column. In another embodiment illustrated in FIG. 2, at least some components of the second heated liquid fraction (e.g., at least a portion of the second heated stream) in conduit 424 can be routed indirectly from second heat exchanger 454 to a second distillation column. For example, in one embodiment, at least some components of the first heated liquid fraction in conduit 424 can first be reintroduced into first distillation column 450 via a liquid inlet 484, as illustrated in FIG. 2. Subsequently, a predominantly liquid bottoms stream comprising at least some components which were present in the first heated liquid fraction in conduit 424 can be withdrawn from first distillation column 450 via liquid bottoms outlet 490, and at least a portion of the withdrawn predominantly liquid bottoms stream can thereafter be routed to a second distillation column via conduit 492. In the indirect route, at least a portion of the second heated stream introduced into the second distillation column can comprise at least a portion of the predominantly liquid bottoms stream from the first distillation column.

In the embodiment wherein at least a portion of the heated liquid stream withdrawn from second heat exchanger 454 is reintroduced into first distillation column 450 as illustrated in FIG. 2, first distillation column 450 can define a maximum liquid depth, D, that is measured from the bottom of first distillation column 450. In addition, first distillation column 450 can comprise a level controller 486. In general, level controller 486 can have an upper level indicator 486*a* that defines a high liquid level 488*a* and a lower level indicator 486*b* that defines a low liquid level 488*b*. In one embodiment, high liquid level 488*a* can be less than the maximum depth D and/or low liquid level 488*b* can be greater than a zero depth. In one embodiment, high liquid level 488*a* can be less than D, less than about 0.95D, less than about 0.90D, or less than 0.80D, and/or can be greater than about 0.55D, greater than about 0.60D, greater than about 0.70D, or greater than 0.75D. In another embodiment, low liquid level 488*b* can be less than about 0.45D, less than about 0.40D, less than about 0.30D, or less than 0.25D and/or greater than about 0.05D, greater than about 0.10D, greater than about 0.15D, or greater than 0.20D. In another embodiment wherein a median depth, M, is defined as being half of maximum depth D, high liquid level 488*a* can be any depth between M and D, and low liquid level can be any depth between 0 and M (exclusive of 0). In another embodiment, high and/or low liquid levels 488*a,b* can be within about 0.2M, within about 0.4M, or within about 0.45M during steady-state operation of first distillation column 450. In additional or alternate embodiments, high liquid level 488*a* may be at least 0.2D greater or at least 0.3D greater or at least 0.4D greater than low liquid level 488*b*. In general, D can be 0.3 meter or more (at least 1 foot), or 0.6 meter or more (at least 2 feet), or about 1 meter or more (at least 3 feet), or may be about 3 meter or less (at most 9 feet), or about 2 meter or less (at most 6 feet), or about 1.3 meter or less (at most 4 feet). In operation, the actual liquid level in first distillation column 450 can be allowed to vary between high liquid level 488*a* and low liquid level 488*b*. This dual liquid level control philosophy is in direct contrast to conventional column operation, which typically attempts to maintain the liquid level within a much narrower control band.

In one embodiment of the present invention represented by FIG. 2, the process equipment and vessels can be positioned in certain relative positions. For example, in one embodiment, the bottom of second heat exchanger 454 and the bottom of vapor-liquid separator 453 can be positioned at substantially the same vertical elevation (e.g., Elevation 1). In another embodiment, the liquid level in separating zone 476*b* of second heat exchanger 454 can be maintained at substantially the same vertical elevation as liquid inlet 484 of first distillation column 450 (e.g., Elevation 2). In another embodiment, when second heat exchanger 454 is a kettle-type heat exchanger, the liquid level maintained in vapor-liquid separator 453 can be at substantially the same vertical elevation as the uppermost edge of internal weir 474 (e.g., Elevation 3).

In another embodiment, the liquid and vapor inlets of first distillation column 450 and/or first or second heat exchanger 452, 454 can be positioned at certain relative vertical positions. For example, in one embodiment, liquid outlet 460 of first distillation column 450 can be positioned at a higher vertical elevation than at least one of vapor inlet 483 and liquid inlet 484. When second heat exchanger 454 comprises a kettle-type heat exchanger, liquid inlet 484 of first distillation column 450 can be positioned at a vertical elevation below the uppermost edge of internal weir 474 (e.g., below Elevation 3) as depicted in FIG. 2. In some embodiments, liquid inlet 484 of first distillation column 450 can be positioned at a higher vertical elevation than the bottom edge of internal weir 474, (e.g., above Elevation 1) as depicted in FIG. 2. In other embodiments, liquid inlet 484 of first distillation column 450 may be positioned at a lower vertical elevation than the bottom edge of internal weir 474 (e.g., below Elevation 1). According to that embodiment, conduit 424 can additionally comprises a liquid pocket, which may allow various instrumentation components (not shown), such as, for example, an analyzer, to obtain proper readings of stream composition and/or physical characteristics. In one embodiment, liquid inlet 484 of first distillation column 450 can be positioned at a lower vertical elevation than the uppermost edge of internal weir 474 and can also be positioned at a higher vertical elevation than the bottom edge of internal weir 474 (e.g., between Elevations 2 and 3), as depicted in FIG. 2. The analyzer, which can be positioned on or near outlet 482 of second heat exchanger 454, may allow control of the heating medium passing through tube bundle 478, which can enables the duty of the second heat exchanger 454 to be adjusted as required for varying compositions of the natural gas feed to heavies removal system or of the natural gas feed to a liquefaction system integrated with the heavies removal system of FIG. 2, such as natural gas stream in conduit 100 depicted in LNG facility of FIG. 1.

In additional or alternate embodiments, the liquid level of vapor-liquid separator 453 and the bottom of the second heat exchanger 454 can be at substantially the same vertical elevation.

Generally, internal weir 474 can have a maximum height (H) defined as the vertical distance between the uppermost edge and the bottom of the weir. In one embodiment, liquid inlet 484 of first distillation column can be positioned at a vertical elevation that is at least about 0.25H, at least about 0.4H, or at least 0.45H below the uppermost edge of internal weir 474. As a result, the reboiler system illustrated in FIG. 2 may be operated in the absence of a mechanical pressure increasing device, such as, for example a pump or compressor. For example, at least a portion of the first predominately liquid stream exiting from upper liquid outlet 460 of the first distillation column 450 can flow in conduit 410 through the first and second heat exchangers 452, 454, and into lower liquid inlet 484 of the first distillation column 450 without the aid of a mechanical pump or compressor. For another example, the stream flowing from outlet 482 of second heat exchanger 454 through conduit 424 and into liquid inlet 484 of first distillation column 450 can be solely driven by hydrostatic pressure difference.

In some embodiments of FIG. 2, first heat exchanger 452, vapor-liquid separator 453, and second heat exchanger 454 may be located in close proximity to each other. The close distance can reduce the length of piping and thus minimizes frictional pressure drops. The short-length piping for flow communication between separator 453 and exchangers 452, 454 thus would reduce the height of first distillation column 450 and/or the hydrostatic head driving force needed for passing at least a portion of first predominantly liquid stream exiting outlet 460 from first distillation column 450 through the two first and second heat exchangers 452, 454 and back to first distillation column 450. The minimum distance between separator 453 and exchangers 452, 454 would be sufficient to allow enough space (for example 0.2-1 meter or a few feet for an operator and/or a robotic arm) to perform repairs and/or maintenance of the pieces of equipment and the piping connecting them. The distance between separator 453 and exchangers 452, 454 should be less than about 200 meters (about 600 feet), or less than about 100 meters (about 300 feet), or less than about 50 meters (about 150 feet).

FIGS. 3*a-c* and 4*a-c* present several embodiments of specific configurations of the LNG facility described previously with respect to FIG. 1. To facilitate an understanding of FIGS. 3*a-c* and 4*a-c*, the following numeric nomenclature was employed. Items numbered 31 through 49 are process vessels and equipment directly associated with first propane refrigeration cycle 30, and items numbered 51 through 69 are process vessels and equipment related to second ethylene refrigeration cycle 50. Items numbered 71 through 94 correspond to process vessels and equipment associated with third methane refrigeration cycle 70 and/or expansion section 80.

Items numbered 96 through 99 are process vessels and equipment associated with heavies removal zone 95. Items numbered 100 through 199 correspond to flow lines or conduits that contain predominantly methane streams. Items numbered 200 through 299 correspond to flow lines or conduits which contain predominantly ethylene streams. Items numbered 300 through 399 correspond to flow lines or conduits that contain predominantly propane streams. Items numbered 500 through 599 correspond to process vessels, equipment, and flow conduits related to one embodiment of the heavies removal zone illustrated in FIGS. 3*b* and 3*c*, while items numbered 600 through 699 correspond to process vessels, equipment, and flow conduits related to the heavies removal zone illustrated in FIGS. 4*b* and 4*c*.

Figure 3A:
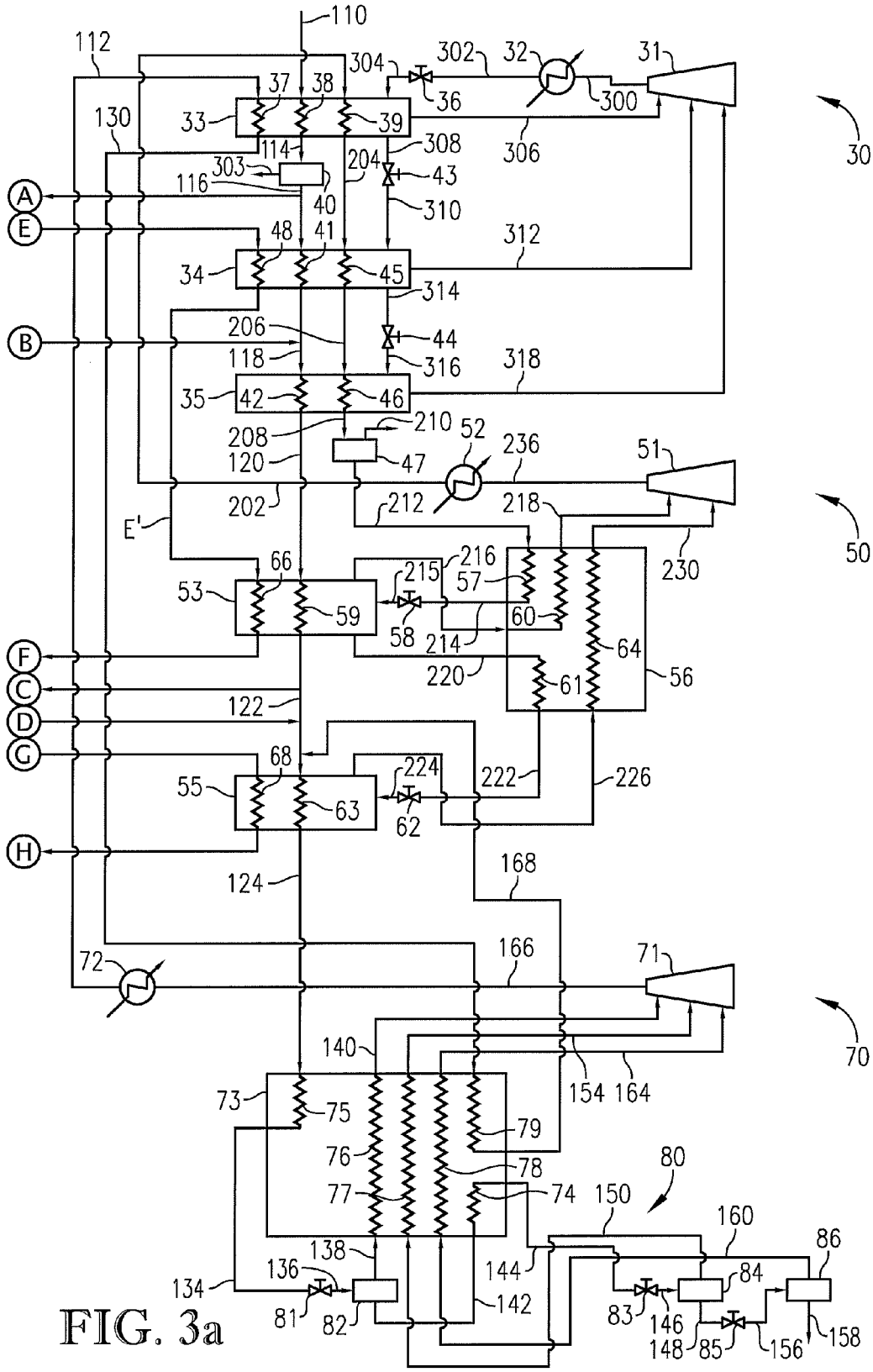
FIG. 3*a* is a schematic diagram of a cascade-type LNG facility configured in accordance with one embodiment of present invention with certain portions of the LNG facility connecting to lines A, B, C, D, E, F, G, and H being illustrated in FIG. 3*b* or 3*c;*
Figure 3B:
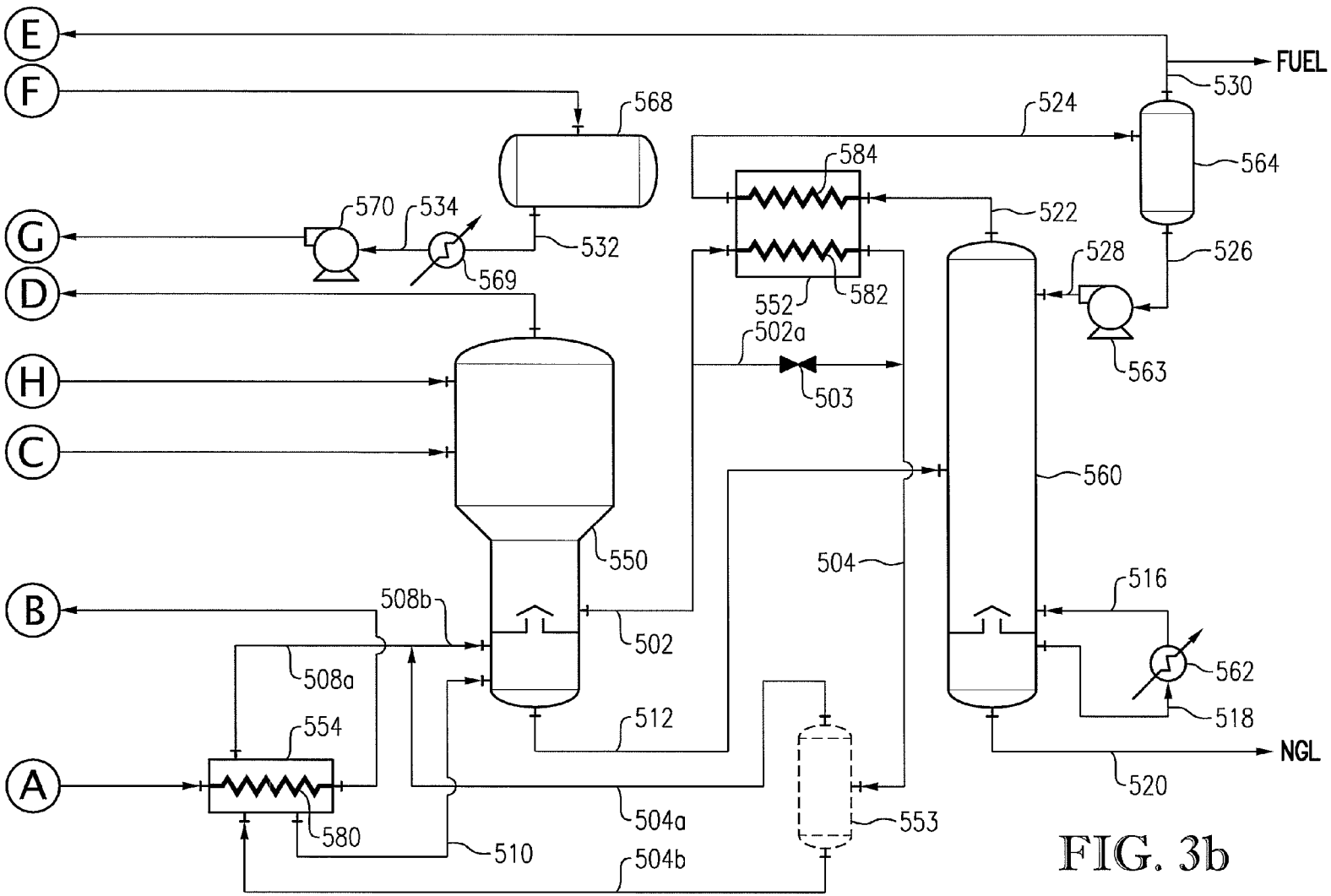
FIG. 3*b* is a schematic diagram illustrating one embodiment of a heavies removal zone integrated into the LNG facility of FIG. 3*a* via lines A, B, C, D, E, F, G, and H.
Figure 3C:
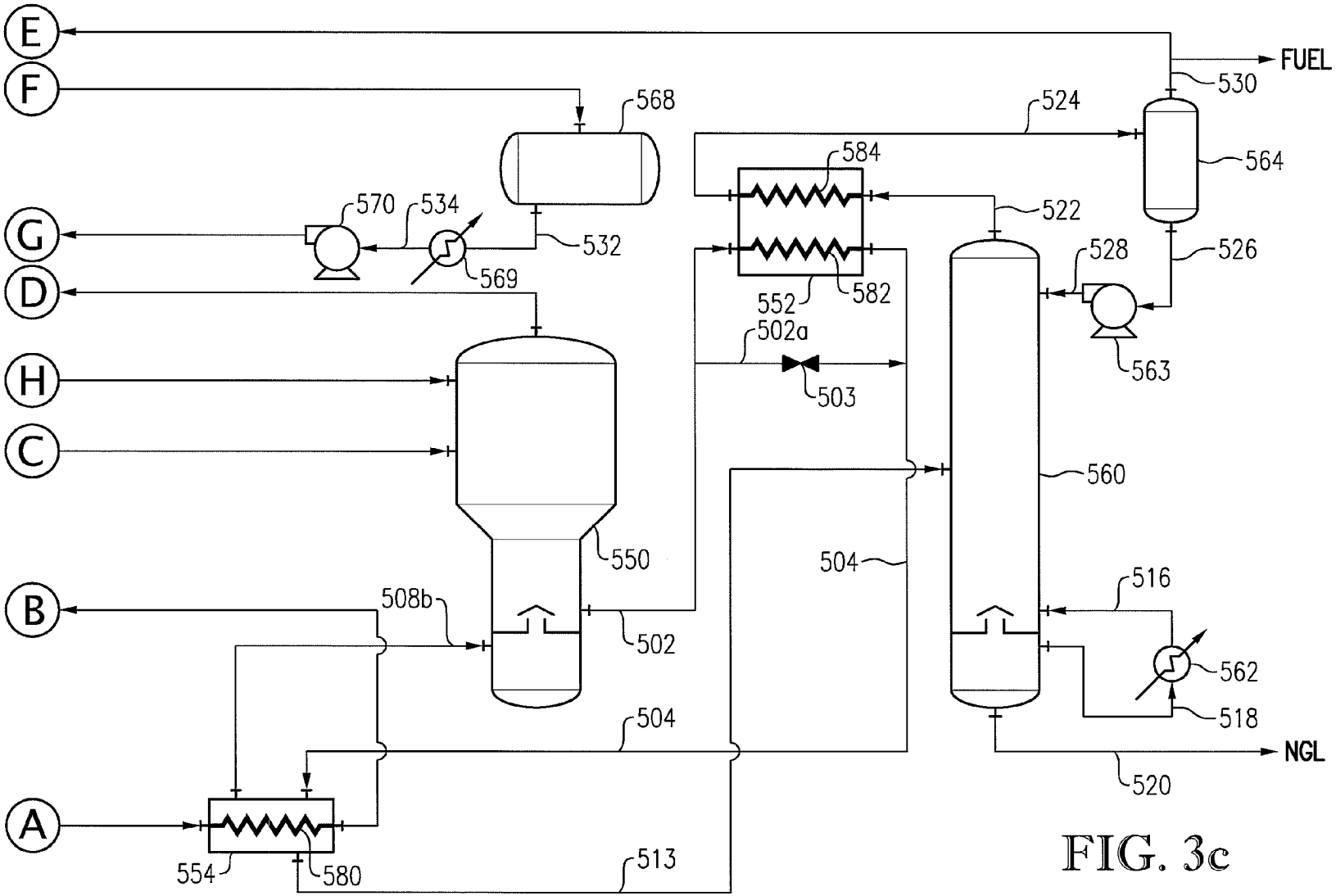
FIG. 3*c* is a schematic diagram illustrating another embodiment of a heavies removal zone integrated into the LNG facility of FIG. 3*a* via lines A, B, C, D, E, F, G, and H.

Referring now to FIG. 3*a*, a cascade-type LNG facility in accordance with one embodiment of the present invention is illustrated. The LNG facility depicted in FIG. 3*a* generally comprises a propane refrigeration cycle 30, an ethylene refrigeration cycle 50, and a methane refrigeration cycle 70 with an expansion section 80. FIGS. 3*b* and 3*c* illustrate embodiments of heavies removal zones capable of being integrated into the LNG facility depicted in FIG. 3*a*. While "propane," "ethylene," and "methane" are used to refer to respective first, second, and third refrigerants, it should be understood that the embodiment illustrated in FIG. 3*a* and described herein can apply to any combination of suitable refrigerants. The main components of propane refrigeration cycle 30 include a propane compressor 31, a propane cooler 32, a high-stage propane chiller 33, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a high-stage methane expander 81, a high-stage methane flash drum 82, an intermediate-stage methane expander 83, an intermediate-stage methane flash drum 84, a low-stage methane expander 85, and a low-stage methane flash drum 86. FIGS. 3*b* and 3*c* present embodiments of a heavies removal zone that is integrated into the LNG facility depicted in FIG. 3*a* via lines A-H. The configuration and operation of the heavies removal zones illustrated in FIGS. 3*b* and 3*c* will be discussed in detail shortly.

The operation of the LNG facility illustrated in FIG. 3*a* will now be described in more detail, beginning with propane refrigeration cycle 30. Propane is compressed in multi-stage (e.g., three-stage) propane compressor 31 driven by, for example, a gas turbine driver (not illustrated). The three stages of compression preferably exist in a single unit, although each stage of compression may be a separate unit and the units mechanically coupled to be driven by a single driver. Upon compression, the propane is passed through conduit 300 to propane cooler 32, wherein it is cooled and liquefied via indirect heat exchange with an external fluid (e.g., air or water). A representative temperature and pressure of the liquefied propane refrigerant exiting cooler 32 is about 100° F. (about 38° C.) and about 190 psia (about 1,310 kPa). The stream from propane cooler 32 can then be passed through conduit 302 to a pressure reduction means, illustrated as expansion valve 36, wherein the pressure of the liquefied propane is reduced, thereby evaporating or flashing a portion thereof. The resulting two-phase stream then flows via conduit 304 into high-stage propane chiller 33. High stage propane chiller 33 uses indirect heat exchange means 37, 38, and 39 to cool respectively, the incoming gas streams, including a yet-to-be-discussed methane refrigerant stream in conduit 112, a natural gas feed stream in conduit 110, and a yet-to-be-discussed ethylene refrigerant stream in conduit 202 via indirect heat exchange with the vaporizing refrigerant. The cooled methane refrigerant stream exits high-stage propane chiller 33 via conduit 130 and can subsequently be routed to the inlet of main methane economizer 73, which will be discussed in greater detail in a subsequent section.

The cooled natural gas stream from high-stage propane chiller 33 (also referred to herein as the "methane-rich stream") flows via conduit 114 to a separation vessel 40, wherein the gaseous and liquid phases are separated. The liquid phase, which can be rich in propane and heavier components ($C_3$+), is removed via conduit 303. The predominately methane stream in vapor phase exits separator 40 via conduit 116. Thereafter, a portion of the stream in conduit 116 can be routed via conduit A to a heavies removal zone illustrated in FIG. 3*b* or 3*c*, which will be discussed in detail shortly. The remaining portion of the predominantly methane stream in conduit 116 can then enter intermediate-stage propane chiller 34, wherein the stream is cooled in indirect heat exchange means 41 via indirect heat exchange with a yet-to-be-discussed propane refrigerant stream. The resulting two-phase methane-rich stream in conduit 118 can then be recombined with a yet-to-be-discussed stream in conduit B exiting heavies removal zone illustrated in FIG. 3*b* or 3*c*, and the combined stream can then be routed to low-stage propane chiller 35, wherein the stream can be further cooled via indirect heat exchange means 42. The resultant cooled predominantly methane stream can then exit low-stage propane chiller 35 via conduit 120. Subsequently, the cooled methane-rich stream in conduit 120 can be routed to high-stage ethylene chiller 53, which will be discussed in more detail shortly.

The vaporized propane refrigerant exiting high-stage propane chiller 33 is returned to the high-stage inlet port of propane compressor 31 via conduit 306. The residual liquid propane refrigerant in high-stage propane chiller 33 can be passed via conduit 308 through a pressure reduction means, illustrated here as expansion valve 43, whereupon a portion of the liquefied propane refrigerant is flashed or vaporized. The resulting cooled, two-phase refrigerant stream can then enter intermediate-stage propane chiller 34 via conduit 310, thereby providing coolant for the natural gas stream (in conduit 116 which is not routed in conduit A) and two yet-to-be-discussed streams entering intermediate-stage propane chiller 34 via conduits 204 and E. The vaporized portion of the propane refrigerant exits intermediate-stage propane chiller 34 via conduit 312 and can then enter the intermediate-stage inlet port of propane compressor 31. The liquefied portion of the propane refrigerant exits intermediate-stage propane chiller 34 via conduit 314 and is passed through a pressure-reduction means, illustrated here as expansion valve 44, whereupon the pressure of the liquefied propane refrigerant is reduced to thereby flash or vaporize a portion thereof. The resulting vapor-liquid refrigerant stream can then be routed via conduit 316 to low-stage propane chiller 35 via conduit 316 and where the refrigerant stream can cool the methane-rich stream and a yet-to-be-discussed ethylene refrigerant stream entering low-stage propane chiller 35 via conduits 118 and 206, respectively. The vaporized propane refrigerant stream then exits low-stage propane chiller 35 and is routed to the low-stage inlet port of propane compressor 31 via conduit 318 wherein it is compressed and recycled as previously described.

As shown in FIG. 3*a*, a stream of ethylene refrigerant in conduit 202 enters high-stage propane chiller 33, wherein the ethylene stream is cooled via indirect heat exchange means 39 and can be at least partially condensed. The resulting cooled ethylene stream can then be routed in conduit 204 from high-stage propane chiller 33 to intermediate-stage propane chiller 34. Upon entering intermediate-stage propane chiller 34, the ethylene refrigerant stream can be further cooled via indirect heat exchange means 45 in intermediate-stage propane chiller 34. The resulting two-phase ethylene stream can then exit intermediate-stage propane chiller 34 and can be routed via conduit 206 to enter low-stage propane chiller 35. In low-stage propane chiller 35, the ethylene refrigerant stream can be at least partially condensed, or condensed in its entirety, via indirect heat exchange means 46. The resulting stream exits low-stage propane chiller 35 via conduit 208 and can subsequently be routed to a separation vessel 47, wherein a vapor portion of the stream, if present, can be removed via conduit 210, while a liquid portion of the ethylene refrigerant stream can exit separator 47 via conduit 212. The liquid portion of the ethylene refrigerant stream exiting separator 47 can have a representative temperature and pressure of about −24° F. (about −31° C.) and about 285 psia (about 1,965 kPa).

Turning now to ethylene refrigeration cycle 50 in FIG. 3*a*, the liquefied ethylene refrigerant stream in conduit 212 can enter ethylene economizer 56, wherein the stream can be further cooled by an indirect heat exchange means 57. The resulting cooled liquid ethylene stream in conduit 214 can then be routed through a pressure reduction means, illustrated here as expansion valve 58, whereupon the pressure of the cooled predominantly liquid ethylene stream is reduced to thereby flash or vaporize a portion thereof. The cooled, two-phase stream in conduit 215 can then enter high-stage ethylene chiller 53. In high-stage ethylene chiller 53, at least a portion of the ethylene refrigerant stream can vaporize to thereby cool the methane-rich stream in conduit 120 entering an indirect heat exchange means 59 and to further cool a yet-to-be-discussed stream in conduit E' entering an indirect heat exchange means 66 of high-stage ethylene chiller 53. The vaporized and remaining liquefied ethylene refrigerant exit high-stage ethylene chiller 53 via respective conduits 216 and 220. The vaporized ethylene refrigerant in conduit 216 can re-enter ethylene economizer 56, wherein the stream can be warmed via an indirect heat exchange means 60 prior to entering the high-stage inlet port of ethylene compressor 51 via conduit 218, as shown in FIG. 3*a*.

The remaining liquefied ethylene refrigerant exiting high-stage ethylene chiller 53 in conduit 220 can re-enter ethylene economizer 56, to be further sub-cooled by an indirect heat exchange means 61 in ethylene economizer 56. The resulting sub-cooled refrigerant stream exits ethylene economizer 56 via conduit 222 and can subsequently be routed to a pressure reduction means, illustrated here as expansion valve 62, whereupon the pressure of the refrigerant stream is reduced to thereby vaporize or flash a portion thereof. The resulting, cooled two-phase stream in conduit 224 enters low-stage ethylene chiller/condenser 55. As shown in FIG. 3*a*, a portion of the cooled predominantly methane stream exiting high-stage ethylene chiller 53 can be routed via conduit C to the heavies removal zone in FIG. 3*b* or 3*c* via conduit C while another portion of the cooled predominantly methane stream exiting high-stage ethylene chiller 53 can be routed via conduit 122 to enter indirect heat exchange means 63 of low-stage ethylene chiller/condenser 55. The remaining portion of the cooled predominantly methane stream in conduit 122 can then be combined with a stream exiting the heavies removal zone (e.g. first predominately vapor stream from first distillation column 550 in FIG. 3*b*, 3*c*) in conduit D and/or may be combined with a yet-to-be-discussed stream exiting methane refrigeration cycle 70 in conduit 168, for the resulting composite stream to then enter indirect heat exchange means 63 in low-stage ethylene chiller/condenser 55, as shown in FIG. 3*a*.

In low-stage ethylene chiller/condenser 55, the predominantly methane stream (which can comprise the stream in conduit 122 optionally combined with streams in conduits C and 168) can be at least partially condensed via indirect heat exchange with the ethylene refrigerant entering low-stage ethylene chiller/condenser 55 via conduit 224. The vaporized ethylene refrigerant exits low-stage ethylene chiller/condenser 55 via conduit 226 and can then enter ethylene economizer 56. In ethylene economizer 56, the vaporized ethylene refrigerant stream can be warmed via an indirect heat exchange means 64 prior to being fed into the low-stage inlet port of ethylene compressor 51 via conduit 230. As shown in FIG. 3*a*, a stream of compressed ethylene refrigerant exits ethylene compressor 51 via conduit 236 and can subsequently be routed to ethylene cooler 52, wherein the compressed ethylene stream can be cooled via indirect heat exchange with an external fluid (e.g., water or air). The resulting, at least partially condensed ethylene stream can then be introduced via conduit 202 into high-stage propylene chiller 33 for additional cooling as previously described.

The cooled natural gas stream exiting low-stage ethylene chiller/condenser 55 in conduit 124 can also be referred to as the "pressurized LNG-bearing stream" the "methane-rich stream," and/or the "predominantly methane stream." As shown in FIG. 3*a*, the pressurized LNG-bearing stream exits low-stage ethylene chiller/condenser 55 via conduit 124 prior to entering main methane economizer 73. In main methane economizer 73, the methane-rich stream in conduit 124 can be cooled in an indirect heat exchange means 75 via indirect heat exchange with one or more yet-to-be discussed methane refrigerant streams. The cooled, pressurized LNG-bearing stream exits main methane economizer 73 into conduit 134 and can then be routed via conduit 134 into expansion section 80 of methane refrigeration cycle 70. In expansion section 80, the cooled predominantly methane stream passes through high-stage methane expander 81, whereupon the pressure of this stream is reduced to thereby vaporize or flash a portion thereof. The resulting two-phase methane-rich stream in conduit 136 can then enter high-stage methane flash drum 82, whereupon the vapor and liquid portions of the reduced-pressure stream can be separated. The vapor portion of the reduced-pressure stream (also called the high-stage flash gas) exits high-stage methane flash drum 82 via conduit 138 to then enter main methane economizer 73, wherein at least a portion of the high-stage flash gas can be heated via indirect heat exchange means 76 of main methane economizer 73. The resulting warmed vapor stream exits main methane economizer 73 via conduit 140 and can then be routed to the high-stage inlet port of methane compressor 71, as shown in FIG. 3*a*.

The liquid portion of the reduced-pressure stream exits high-stage methane flash drum 82 via conduit 142 to then re-enter main methane economizer 73, wherein the liquid stream can be cooled via indirect heat exchange means 74 of main methane economizer 73. The resulting cooled stream exits main methane economizer 73 via conduit 144 and can then be routed to a second expansion stage, illustrated here as intermediate-stage expander 83. Intermediate-stage expander 83 reduces the pressure of the cooled methane stream passing therethrough to thereby reduce the stream's temperature by vaporizing or flashing a portion thereof. The resulting two-phase methane-rich stream in conduit 146 can then enter intermediate-stage methane flash drum 84, wherein the liquid and vapor portions of this stream can be separated and can exit the intermediate-stage flash drum 84 via respective conduits 148 and 150. The vapor portion (also called the intermediate-stage flash gas) in conduit 150 can re-enter methane economizer 73, wherein the vapor portion can be heated via an indirect heat exchange means 77 of main methane economizer 73. The resulting warmed stream can then be routed via conduit 154 to the intermediate-stage inlet port of methane compressor 71, as shown in FIG. 3*a*.

The liquid stream exiting intermediate-stage methane flash drum 84 via conduit 148 can then pass through a low-stage expander 85, whereupon the pressure of the liquefied methane-rich stream can be further reduced to thereby vaporize or flash a portion thereof. The resulting cooled, two-phase stream in conduit 156 can then enter low-stage methane flash drum 86, wherein the vapor and liquid phases can be separated. The liquid stream exiting low-stage methane flash drum 86 via conduit 158 can comprise the liquefied natural gas (LNG) product. The LNG product, which is at about atmospheric pressure, can be routed via conduit 158 downstream for subsequent storage, transportation, and/or use.

The vapor stream exiting low-stage methane flash drum (also called the low-stage methane flash gas) in conduit 160 can be routed to methane economizer 73, wherein the low-stage methane flash gas can be warmed via an indirect heat exchange means 78 of main methane economizer 73. The resulting stream can exit methane economizer 73 via conduit 164, whereafter the stream can be routed to the low-stage inlet port of methane compressor 71.

Methane compressor 71 can comprise one or more compression stages. In one embodiment, methane compressor 71 comprises three compression stages in a single module. In another embodiment, the compression modules can be separate, but can be mechanically coupled to a common driver. Generally, when methane compressor 71 comprises two or more compression stages, one or more intercoolers (not shown) can be provided between subsequent compression stages.

As shown in FIG. 3*a*, the compressed methane refrigerant stream exiting methane compressor 71 can be discharged into conduit 166 and routed to methane cooler 72, whereafter the stream can be cooled via indirect heat exchange with an external fluid (e.g., air or water) in methane cooler 72. The resulting cooled methane refrigerant stream exits methane cooler 72 via conduit 112, whereafter the methane refrigerant stream can be directed to and further cooled in propane refrigeration cycle 30, as described in detail previously.

Upon being cooled in propane refrigeration cycle 30 via heat exchanger means 37, the methane refrigerant stream can be discharged into conduit 130 and subsequently routed to main methane economizer 73, wherein the stream can be further cooled via indirect heat exchange means 79. The resulting sub-cooled stream exits main methane economizer 73 via conduit 168 and can then combined with stream in conduit 122 exiting high-stage ethylene chiller 53 and/or with stream in conduit D exiting the heavies removal zone (e.g. first predominately vapor stream from first distillation column 550 in FIG. 3*b*, 3*c*) prior to entering low-stage ethylene chiller/condenser 55, as previously discussed.

Turning now to FIG. 3*b*, one embodiment of a heavies removal zone suitable for integration with the LNG facility depicted in FIG. 3*a* is illustrated. The heavies removal zone generally comprises a first distillation column 550, a first heat exchanger 552, an optional vapor-liquid separator 553, a second heat exchanger 554, and a second distillation column 560. The operation of the heavies removal zone depicted in FIG. 3*b* will now be described in more detail.

Referring now to FIG. 3*b*, at least a portion of the predominantly methane stream withdrawn from conduit 116 in FIG. 3*a* can be routed to the heavies removal zone depicted in FIG. 3*b* via conduit A. As shown in FIG. 3*b*, the stream in conduit A can enter the warm fluid inlet of a cooling pass 580 of second heat exchanger 554, wherein the stream is cooled and at least partially condensed. The resulting stream withdrawn from a cool fluid outlet of second heat exchanger 554 can subsequently be routed back via conduit B to the liquefaction portion of the LNG facility depicted in FIG. 3*a*, as discussed previously.

As shown in FIG. 3*a*, a predominantly methane stream (a portion of natural gas) exiting high-stage ethylene chiller 53 can be withdrawn via conduit C and can be routed to a fluid inlet of first distillation column 550 in the heavies removal zone depicted in FIG. 3*b*. An overhead vapor product (also called "first predominantly vapor stream") can be withdrawn from an overhead vapor outlet of first distillation column 550 via conduit D and can thereafter be routed via conduit D to the liquefaction portion of the LNG facility depicted in FIG. 3*a* to combine with the predominantly methane stream exiting high-stage ethylene chiller 53 in conduit 122 and/or with stream in conduit 168 exiting the main methane economizer 73, as previously discussed.

Turning back to FIG. 3*b*, a first predominantly liquid stream can be withdrawn via a liquid outlet of first distillation column 550 and can be routed via conduit 502 to a cool fluid inlet of a warming pass 582 of first heat exchanger 552, wherein the first predominantly liquid stream can be heated and at least partially vaporized. The resulting two-phase fluid stream (also called "first heated stream") can then exit first heat exchanger 552 via a warm fluid outlet and can then be routed into conduit 504.

As illustrated in FIG. 3*b*, the heavies removal zone depicted in FIG. 3*b* can also comprise a bypass line 502*a* operable to route in bypass line 502*a* at least a portion of the first predominantly liquid stream from conduit 502 directly into conduit 504, thereby routing flow around first heat exchanger 552. In one embodiment, at least about 85, at least about 95, at least about 99 volume percent of the first predominantly liquid stream in conduit 502 can be routed through bypass line 502*a* to thereby avoid passage through first heat exchanger 552. In one embodiment, substantially all of the first predominantly liquid stream in conduit 502 can be routed around first heat exchanger 552 during a period of abnormal (e.g., non-steady state) operation of the heavies removal zone, such as, for example, during start-up or/and shut-down of the heavies removal zone. Once the heavies removal zone has reached or resumed steady-state conditions, a bypass mechanism 503 can be adjusted to decrease the volume of fluid sent through bypass line 502*a* and increase the volume of fluid warmed in first heat exchanger 552. Bypass mechanism 503 can be any device capable of controlling the flow rate through bypass line 502, such as, for example, a valve or other flow control means. Bypass control mechanism 503 can be operated manually (e.g., by an operator) or automatically (e.g., with an on-off controller or a PID controller).

As shown in FIG. 3*b*, the first heated stream in conduit 504 can optionally be introduced into a vapor-liquid separation vessel 553, wherein the first heated stream can be separated into vapor and liquid phases. A separated first heated vapor fraction (which is a predominantly vapor stream) in conduit 504*a* can be withdrawn via an overhead outlet of vapor-liquid separator 553. The separated first heated vapor fraction in conduit 504*a* can then be combined with a yet-to-be-discussed predominantly vapor stream in conduit 508*a* to form a combined stream in conduit 508*b*. A separated first heated liquid fraction (which is a predominantly liquid stream) withdrawn via conduit 504*b* from vapor-liquid separator 553 can be introduced into second heat exchanger 554, wherein the separated first heated liquid fraction can be heated and at least partially vaporized via indirect heat exchange with the predominantly methane stream entering second heat exchanger 554 via conduit A (for example at least a portion of a natural gas stream). In one embodiment depicted in FIG. 3*b*, a separated second heated vapor fraction of the warmed stream can be withdrawn via a warm vapor outlet of second heat exchanger 554 via conduit 508*a*, and can then combine with the separated first heated vapor fraction in conduit 504*a* exiting vapor-liquid separator 553 to form the combined vapor stream in conduit 508*b*. The combined vapor stream in conduit 508*b* can then be reintroduced as a reboiled vapor stream into first distillation column 550, as shown in FIG. 3*b*.

In the absence of the vapor-liquid separation vessel 553 in the heavies removal zone in FIG. 3*b*, the first heated stream in conduit 504 can be routed to second heat exchanger 554, wherein the first heated stream can again be heated into a second heated stream and at least partially vaporized via indirect heat exchange with the predominantly methane stream (e.g., portion of natural gas) entering second heat exchanger 554 via conduit A. In one embodiment depicted in FIG. 3*b*, a separated second heated vapor fraction of the second heated stream can be withdrawn via a warm vapor outlet of second heat exchanger 554 via conduit 508*a*. As shown in FIG. 3*b*, the separated second heated vapor fraction of the second heated stream exiting second heat exchanger 554 via conduit 508*a* can then be reintroduced as a reboiled vapor stream into first distillation column 550.

In one embodiment, a separated second heated liquid fraction can be withdrawn via a liquid outlet of second heat exchanger 554 via conduit 510. The separated second heated liquid fraction exiting second heat exchanger 554 via conduit 510 can also be reintroduced into first distillation column 550. Subsequently, as shown in FIG. 3*b*, a predominantly liquid bottoms stream can be withdrawn via conduit 512 from a liquid bottoms outlet of first distillation column 550 and can then be introduced into a fluid inlet of second distillation column 560. The liquid bottoms outlet of first distillation column 550 is located at a lower vertical elevation than (i.e., below) the vapor inlet of first distillation column 550 (through which reboiled vapor fraction in conduit 508*a* passes). In one embodiment, the temperature of the predominantly liquid bottoms stream in conduit 512 can be in the range of from about −25° F. to about 40° F. (from about −32° C. to about 4.5° C.), from about −15° F. to about 30° F. (from about −26° C. to about −1° C.), or from −5° F. to 25° F. (from −21° C. to −4° C.). In general, the feed stream introduced into the second distillation column 560 via conduit 512 (e.g., predominantly liquid bottoms stream) can comprise less than about 50 mole percent (mol. %) methane, or in the range of from about 10 mol. % to about 40 mol. % methane, or from 15 mol. % to 30 mol. % methane, and can comprise in the range of from about 15 mol. % to about 65 mol. % ethane, from about 20 mol. % to about 50 mol. % ethane, or from 25 mol. % to 45 mol. % ethane. Typically, the predominantly liquid bottoms stream in conduit 512 can comprise greater than about 30 mol. %, greater than about 35 mol. %, or greater than 45 mol. % of propane and heavier components.

Turning back to FIG. 3*b*, a second overhead vapor stream in conduit 522 (also called "second predominately vapor stream") can be withdrawn from an overhead vapor outlet of second distillation column 560. In one embodiment, the second predominately vapor stream withdrawn from overhead of second distillation column 560 can comprise less than about 45 mol. % methane, or in the range of from about 15 mol. % to about 40 mol. % methane, or from 20 mol. % to 30 mol. % methane, and greater than about 50 mol. % ethane, or in the range of from about 60 mol. % to about 85 mol. % ethane or from 65 mol. % to 75 mol. % ethane. Typically, the second predominantly vapor stream in conduit 522 can comprise less than about 10 mol. %, less than about 5 mol. %, or less than 3 mol. % propane and heavier components.

As shown in FIG. 3*b*, the second predominantly vapor stream exiting the second column overhead in conduit 522 can then be routed to a warm fluid inlet of a cooling pass 584 of first heat exchanger 552. The resulting cooled, at least partially condensed stream (also called "condensed liquid stream") can be withdrawn via a cool fluid outlet and then routed via conduit 524 to a second reflux accumulator vessel 564, wherein the stream can be separated into vapor and liquid phases. An overhead vapor fraction exits second reflux accumulator vessel 564 via conduit 530 and is predominately vapor. A reflux liquid fraction exits second reflux accumulator vessel 564 near or at the bottom via conduit 526, and the reflux liquid fraction is predominately liquid. At least a portion of the overhead vapor fraction withdrawn via conduit 530 can be utilized as fuel gas within the facility. The remaining portion of the overhead vapor fraction can be routed back via conduit E to the liquefaction portion of the LNG facility depicted in FIG. 3*a*. At least a fraction of the reflux liquid fraction withdrawn via conduit 526 can be utilized as a reflux stream in the second distillation column 560.

Referring now to FIG. 3*a*, at least a portion of the stream in conduit E can be routed into intermediate-stage propane chiller 34, wherein the stream can be cooled in cooling pass 48 via indirect heat exchange with the vaporizing propane refrigerant, as discussed in detail previously. The resulting cooled stream in conduit E can then be routed via conduit E' into the warm fluid inlet of cooling pass 66 of high-stage ethylene chiller 53, wherein the stream is further cooled via indirect heat exchange with the vaporizing ethylene refrigerant. The resulting cooled stream can then be routed via conduit F back to the heavies removal zone depicted in FIG. 3*b*.

Turning back to FIG. 3*b*, the cooled, at least partially condensed stream in conduit F can then be introduced into a first reflux accumulator 568, wherein the liquid and vapor portions, if present, can be separated. A liquid stream can be withdrawn via conduit 532 and can be further cooled via a reflux heat exchanger 569. The resulting cooled stream in conduit 534 can then enter the suction of first reflux pump 570 and can thereafter be discharged into conduit G. As illustrated in FIG. 3*a*, the stream in conduit G can be further cooled in low-stage ethylene chiller/condenser 55 via indirect heat exchange means 68 and the resulting cooled stream can then be routed back via conduit H to the heavies removal zone illustrated in FIG. 3*b*, wherein at least a portion of the stream can be used as a reflux stream in first distillation column 550. In general, the temperature of the reflux stream in conduit H can be in the range of from about −195° F. to about −75° F. (from about −126° C. to about −59° C.), from about −185° F. to about −95° F. (from about −120° C. to about −70° C.), or from −170° F. to −100° F. (from −112° C. to −73° C.). Typically, the reflux stream to first distillation column can comprise in the range of from about 30 mol. % to about 80 mol. % methane and/or ethane, from about 35 mol. % to about 75 mol. % methane and/or ethane, or from 40 mol. % to 60 mol. % methane and/or ethane and less than about 5 mol. %, less than about 2 mol. %, or less than 1 mol. % of propane and heavier components.

Referring again to FIG. 3*b*, the reflux fraction exiting second reflux accumulator 564 via conduit 526 can subsequently enter the suction of second reflux pump 563. The pressurized stream discharged into conduit 528 can enter a reflux inlet of second distillation column 560, whereafter the pressurized stream can be employed as reflux to the second distillation column 560. Typically, the temperature of the reflux stream in conduit 528 can be in the range of from about −25° F. to about 35° F. (from about −32° C. to about 2° C.), from about −15° F. to about 25° F. (from about −26° C. to about −4° C.), or from −5° F. to 15° F. (from −21° C. to −9° C.). The reflux stream in conduit 528 can comprise less than 30 mol. % methane or in the range of from about 5 mol. % to about 25 mol. % methane, or about 10 mol. % to about 20 mol. % methane, and greater than about 60 mol. % ethane or in the range of from about 70 mol. % to about 95 mol. % ethane, or from 75 mol. % to 90 mol. % ethane. Typically, the reflux stream in conduit 528 to second distillation column 560 can comprise less than about 10 mol. %, less than about 5 mol. %, or less than about 3 mol. % of propane and heavier components.

As shown in FIG. 3*b*, a liquid stream can be withdrawn from a liquid outlet near the lower portion of second distillation column 560 into conduit 518. The stream in conduit 518 can then be passed through heat exchanger 562, wherein the stream can be at least partially vaporized. The resulting two-phase stream can then be reintroduced into second distillation column 560 via conduit 516.

A second predominantly liquid bottoms stream can be withdrawn from a liquids bottom outlet of second distillation column 560 via conduit 520. The second predominantly liquid bottoms stream in conduit 520 generally comprises recovered natural gas liquids (NGL) and can be routed to further processing, use, or storage.

Referring now to FIG. 3*c*, another embodiment of a heavies removal zone capable of being integrated into the LNG facility depicted in FIG. 3*a* is shown. Items and streams illustrated in FIG. 3*c* that are similar to those depicted in FIG. 3*b* are designated with the same reference numerals. The heavies removal zone illustrated in FIG. 3*c* generally comprises a first distillation column 550, a first heat exchanger 552, a second heat exchanger 554, and a second distillation column 560. The operation of the heavies removal zone illustrated in FIG. 3*c*, as it differs from that previously described with respect to FIG. 3*b*, will now be described in more detail.

As shown in FIG. 3*c*, a separated second heated liquid stream (which is predominantly liquid) can be withdrawn via a warm liquid outlet from second heat exchanger 554 and can subsequently be routed via conduit 513 to a fluid inlet of second distillation column 560. In one embodiment, the temperature of the second heated liquid stream in conduit 513 can be in the range of from about −25° F. to about 40° F. (from about −31° C. to about 4.5° C.), from about −15° F. to about 30° F. (from about −26° C. to about −1° C.), or from −5° F. to 25° F. (from about −21° C. to about −4° C.). In general, the feed to second distillation column 560 (e.g., second heated liquid stream in conduit 560) can comprise less than about 50 mol. % methane, or in the range of from about 10 mol. % to about 40 mol. % or from 15 mol. % to 30 mol. % methane and can comprise in the range of from about 15 mol. % to about 65 mol. % ethane, from about 20 mol. % to about 50 mol. %, or from 25 mol. % to 45 mol. % ethane. Typically, the stream in conduit 512 can comprise greater than about 30 mol. %, greater than about 35 mol. %, or greater than 45 mol. % of propane and heavier components.

FIGS. 3*b* and 3*c* respectively illustrate embodiments showing the indirect and direct passing of some components (generally the heavies) which are present in the resulting second heated stream (which was twice-heated by passing through two heat exchangers) to second distillation column 560 for further separation. In FIG. 3*b*, at least a portion of the twice-heated heavies-containing stream (e.g., at least some heavies components) in conduit 510 exiting second heat exchanger 554 is reintroduced into first distillation column 550, where some of these heavies components collect in the liquid phase at the bottom of the first distillation column 550 and then are withdrawn via conduit 512 to be sent to second distillation column 560 for further separation. On the other end, in FIG. 3*c*, at least a portion of the twice-heated heavies-containing stream (e.g., at least some heavies components) in conduit 513 exiting second heat exchanger 554 is directly sent to second distillation column 560 for further separation.

With respect to the optional vapor-liquid separator 553 depicted in FIG. 3*b*, it should be understood that its operation is similar to what is previously described for vapor-liquid separator 453 in FIG. 2. Furthermore, it should be understood that although a vapor-liquid separator 553 is not depicted in FIG. 3*c*, the heavies removal zone in FIG. 3*c* can further employ a vapor-liquid separator (similar to separators 453, 543 of FIGS. 2 & 3*b* respectively) to separate the first heated stream in conduit 604 into vapor and liquid phases and provide separated first heated vapor and liquid fractions (such as streams 504*a,b* in FIG. 3*b*) as previously described for the heavies removal zones depicted on FIGS. 2 & 3*b*.

Figure 4A:
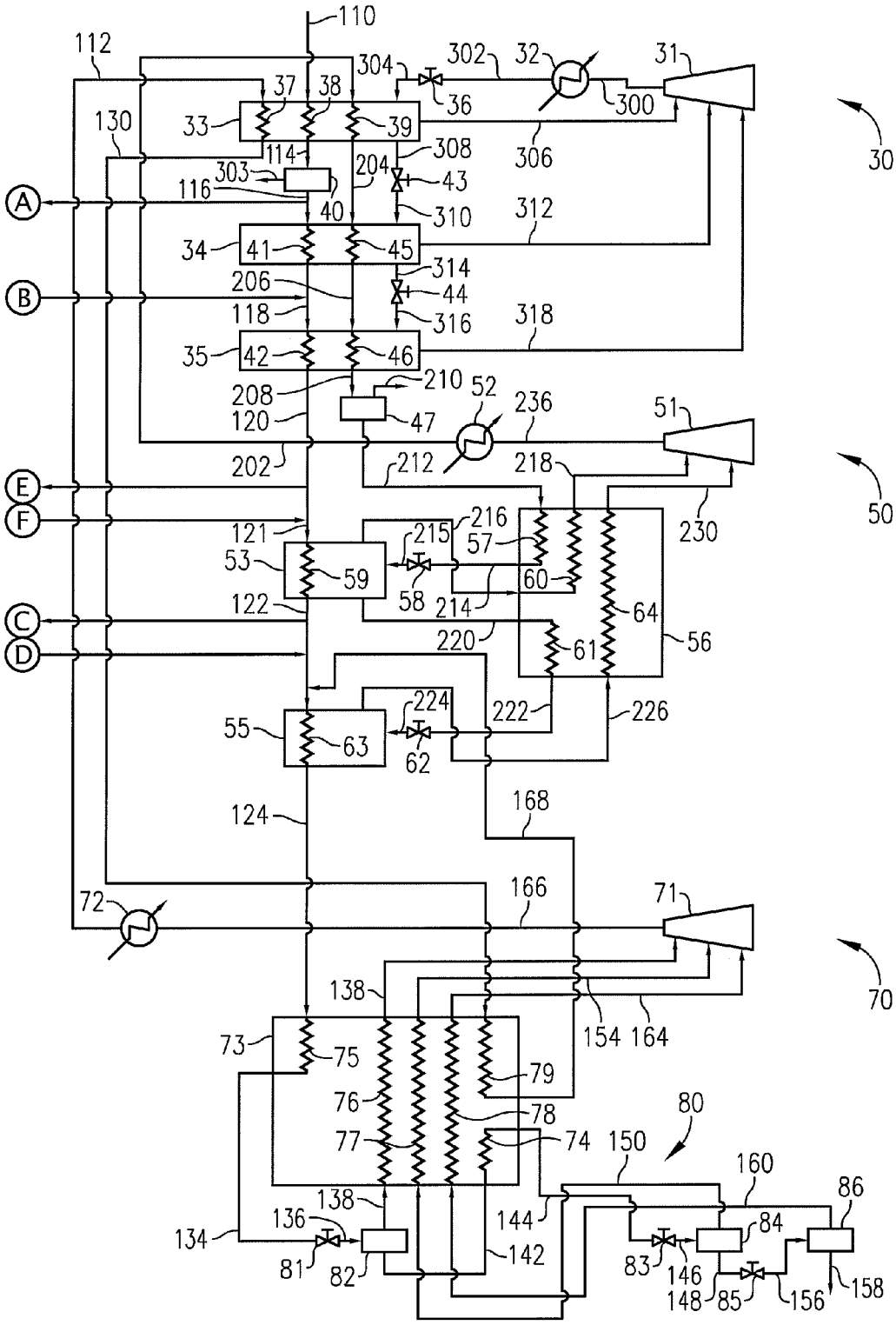
FIG. 4*a* is a schematic diagram of a cascade-type LNG facility configured in accordance with one embodiment of present invention with certain portions of the LNG facility connecting to lines A, B, C, D, E, and F being illustrated in FIG. 4*b* or 4*c;*
Figure 4B:
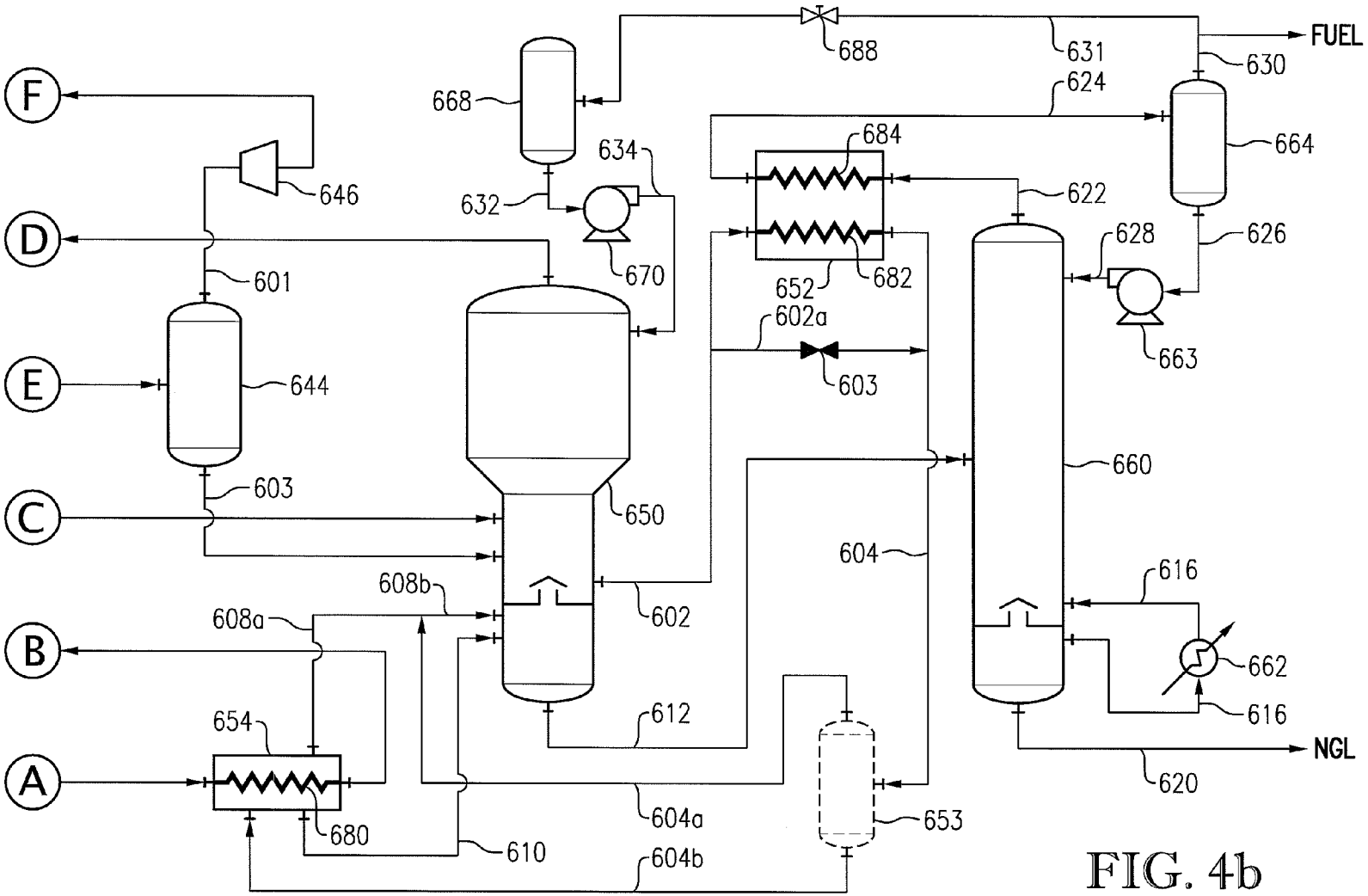
FIG. 4*b* is a schematic diagram illustrating one embodiment of a heavies removal zone integrated into the LNG facility of FIG. 4*a* via lines A, B, C, D, E, and F.
Figure 4C:
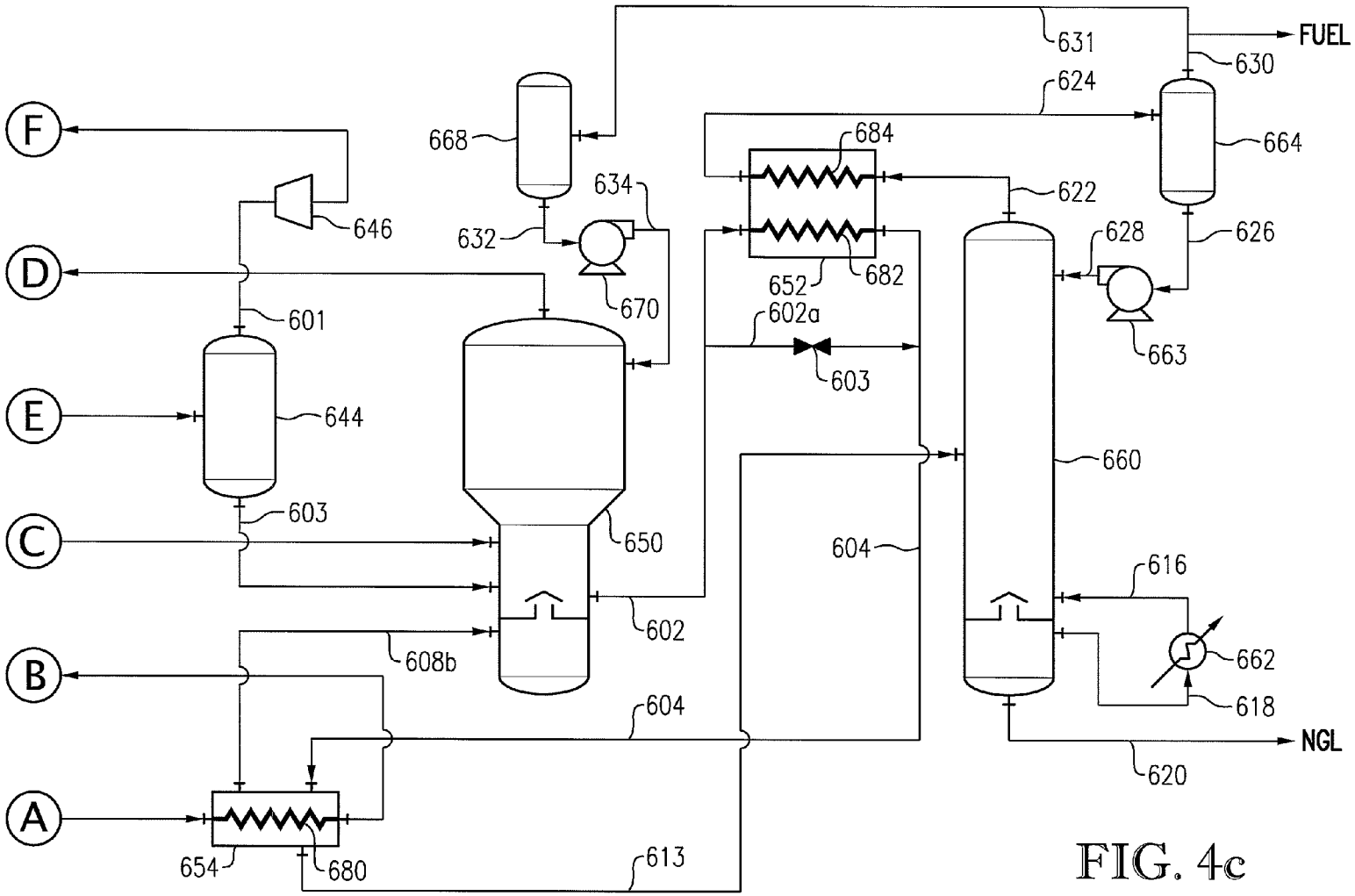
FIG. 4*c* is a schematic diagram illustrating another embodiment of a heavies removal zone integrated into the LNG facility of FIG. 4*a* via lines A, B, C, D, E, and F.

Referring now to FIG. 4*a*, another embodiment of a cascade-type LNG facility in accordance with one embodiment of the present invention is illustrated. The LNG facility depicted in FIG. 4*a* generally comprises a propane refrigeration cycle 30, a ethylene refrigeration cycle 50, and a methane refrigeration cycle 70 with an expansion section 80. FIGS. 4*b* and 4*c* illustrate embodiments of heavies removal zones capable of being integrated into the LNG facility depicted in FIG. 4*a*. The main components of the LNG facility depicted in FIG. 4*a* are the same as those previously described with respect to FIG. 3*a* and like components have been designated with the same reference numerals. FIGS. 4*b* and 4*c* present embodiments of a heavies removal zone that is integrated into the LNG facility depicted in FIG. 4*a* via lines A-H. The configuration and operation of the heavies removal zones illustrated in FIGS. 3*b* and 3*c* will be discussed in detail shortly.

The operation of the LNG facility illustrated in FIG. 4*a*, as it differs from the operation of the LNG facility previously discussed with respect to FIG. 3*a*, will now be described in more detail. The cooled, predominantly methane stream in conduit 120 exiting low-stage propane chiller 35 can thereafter be split into two portions, as shown in FIG. 4*a*. The first portion can be routed via conduit E to a heavies removal zone as depicted in FIG. 4*b* or 4*c* via conduit E while the remaining portion can combine with a yet-to-be-discussed stream in conduit F exiting the heavies removal zone. Thereafter, the combined methane-rich stream in conduit 121 can be routed to high-stage ethylene chiller 53, and then can be and cooled in indirect heat exchange means 59 of high-stage ethylene chiller 53. As shown in FIG. 4*a*, the cooled predominantly methane stream can then exit high-stage ethylene chiller 53 via conduit 122 and can thereafter proceed through the liquefaction and expansion process as previously described with respect to FIG. 3*a*.

Turning now to FIG. 4*b*, one embodiment of a heavies removal zone suitable for integration with the LNG facility depicted in FIG. 4*a* is illustrated. Items and streams illustrated in FIG. 4*b* that are similar to those depicted in FIG. 3*b* are designated with similar reference numerals. The heavies removal zone depicted in FIG. 4*b* generally comprises a first distillation column 650, a first heat exchanger 652, an optional vapor-liquid separator 653, a second heat exchanger 654, and a second distillation column 660. In addition, the heavies removal zone illustrated in FIG. 4*b* comprises a feed separation vessel 644 and an expansion device 646. The operation of the heavies removal zone illustrated in FIG. 4*b*, as it differs from the operation of the heavies removal zone previously discussed with respect to FIG. 3*b*, will now be described in detail.

Referring now to FIG. 4*b*, a predominantly vapor stream withdrawn downstream of low-stage propane chiller 35 via conduit E in FIG. 4*a* (a portion of a natural gas stream) enters the heavies removal zone shown in FIG. 4*b*. As shown in FIG. 4*b*, the stream in conduit E can then be introduced into feed separation vessel 644, wherein the vapor and liquid phases are separated. A predominantly vapor stream can be withdrawn via conduit 601 from separation vessel 644 and can thereafter enter expansion device 646. Expansion device 646 can be any device capable of reducing the pressure of the predominantly vapor stream to thereby condense at least a portion thereof. In one embodiment, expansion device 646 can be an expansion value. In another embodiment, expansion device 646 can be a turboexpander. The resulting cooled, two-phase stream exiting expansion device 646 via conduit F can then be reintroduced into the liquefaction portion of the LNG facility depicted in FIG. 4*a*. Referring back to FIG. 4*b*, a predominantly liquid stream can be withdrawn via conduit 603 from feed separation vessel 644 and can thereafter be introduced into first distillation column 650 via a second liquid inlet.

Turning now to the second predominantly vapor stream (also called "second overhead stream") withdrawn via conduit 622 from second distillation column 660, the stream can then enter cooling pass 684 of second heat exchanger 652, wherein the stream can be cooled and at least partially condensed. The resulting cooled two-phase stream can then be routed via conduit 624 to a second reflux accumulator 664. As shown in FIG. 4*b*, a predominantly vapor stream separated in accumulator 664 from the cooled two-phase stream can be withdrawn via conduit 630 from second reflux accumulator 664. A portion of this predominantly vapor stream can thereafter be routed to be used as fuel, while the remaining portion in conduit 631 can be passed through a pressure reduction means 688, and the resulting two-phase stream can then be introduced into a first reflux vessel 668. A predominantly liquid stream separated in first reflux accumulator 668 from the stream in conduit 631 can then be withdrawn from first reflux accumulator 668 via conduit 632 and can thereafter enter the suction of first reflux pump 670. A pressurized reflux stream in conduit 634 can then be employed as a reflux stream to first distillation column 650. In general, the reflux stream in conduit 634 can have substantially the same temperature and composition as the reflux stream in conduit H of FIG. 3*b*, described in detail above.

Turning now to FIG. 4*c*, another embodiment of a heavies removal zone suitable for integration into the LNG facility depicted in FIG. 4*a* is shown. Items and streams illustrated in FIG. 4*c* that are similar to those depicted in FIG. 4*b* are designated with the same reference numerals. The heavies removal zone in FIG. 4*c* generally comprises a feed separation vessel 644, an expansion device 646, a first distillation column 650, a first heat exchanger 652, a second heat exchanger 654, and a second distillation column 660. Like the heavies removal zone described previously with respect to FIG. 4*b*, the heavies removal zone in FIG. 4*c* receives a predominantly methane stream in conduit E from the liquefaction portion of the LNG facility depicted in FIG. 4*a*, separates the stream in conduit E into a predominantly liquid stream in conduit 603 and a predominantly vapor stream in conduit 601, expands the predominantly vapor stream in expansion device 646 to return the expanded stream in conduct F to the LNG facility depicted in FIG. 4*a*, and introduces the liquid stream into first distillation column 650. Like the heavies removal zone described above with respect to FIG. 3*c*, the heavies removal zone depicted in FIG. 4*c* routes a heated liquid stream from second heat exchanger 654 into second distillation column 660 via conduit 613 without first reintroducing the heated liquid stream into first distillation column 650.

Similarly to FIGS. 3*b* and 3*c*, FIGS. 4*b* and 4*c* respectively illustrate embodiments showing the indirect and direct passing of some components (generally the heavies) which are present in the resulting twice-heated heavies-containing liquid stream (which has passed through two heat exchangers) to second distillation column 660 for further separation. In FIG. 4*b*, at least a portion of the second heated stream (which has been twice-heated, is predominately liquid, and comprises heavies) exiting second heat exchanger 654 in conduit 610, that is to say at least some heavies components of the second heated fraction, is reintroduced into first distillation column 550, where some of these heavies components collect in the liquid phase at the bottom of the first distillation column 650 and then are withdrawn via conduit 612 to be sent to second distillation column 660 for further separation. On the other end, in FIG. 4*c*, at least a portion of the second heated stream (which has been twice-heated, is predominately liquid, and comprises heavies) exiting second heat exchanger 654 in conduit 613, that is to say at least some heavies components of the second heated fraction, is directly sent to second distillation column 660 for further separation.

With respect to the optional vapor-liquid separator 653 depicted in FIG. 4*b*, it should be understood that its operation is similar to what is previously described for optional vapor-liquid separator 553 in FIG. 3*b* and/or vapor-liquid separator 453 in FIG. 2. Furthermore, although a vapor-liquid separator 653 is not depicted in FIG. 4*c*, the heavies removal zone in FIG. 4*c* can further employ a vapor-liquid separator (similar to separators 453, 543, 653 of FIGS. 2, 3*b* & 4*b* respectively) to separate the first heated stream in conduit 604 into vapor and liquid phases and provide separated first heated vapor and liquid fractions (such as streams 604*a,b* in FIG. 4*b*) as previously described for the heavies removal zones depicted on FIGS. 2, 3*b* & 4*b*.

In one embodiment of the present invention, the LNG production systems illustrated in FIGS. 2, 3*a-c*, and 4*a-c* are simulated on a computer using process simulation software in order to generate process simulation data in a human-readable form. In one embodiment, the process simulation data can be in the form of a computer print out. In another embodiment, the process simulation data can be displayed on a screen, a monitor, or other viewing device. The simulation data can then be used to manipulate the operation of the LNG system and/or design the physical layout of an LNG facility. In one embodiment, the simulation results can be used to design a new LNG facility and/or revamp or expand an existing facility. In another embodiment, the simulation results can be used to optimize the LNG facility according to one or more operating parameters. Examples of suitable software for producing the simulation results include HYSYS™ or Aspen Plus® from Aspen Technology, Inc., and PRO/II® from Simulation Sciences Inc.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of from 10 to 100 provides literal support for a claim reciting "greater than 10" or "at least 10" (with no upper bounds) and a claim reciting "less than 100" or "at most 100" (with no lower bounds).

DEFINITIONS

As used herein, the terms "a," "an," "the," and "said" mean one or more.

As used herein, the terms "vol. %" means percent by volume.

As used herein, the terms "mol. %" means percent by mole.

As used herein, the term "and/or," when used in a list of two or more items, means that any one of the listed items can be employed by itself, or any combination of two or more of the listed items can be employed (i.e., at least one of said items can be employed). For example, if a composition is described as containing components A, B, and/or C, the composition can contain A alone; B alone; C alone; A and B in combination; A and C in combination; B and C in combination; or A, B, and C in combination.

As used herein, a "$C_n$" hydrocarbon represents a hydrocarbon with 'n' carbon atoms. Similarly, "$C_{n+}$" hydrocarbons" or "$C_{n+}$" hydrocarbonaceous compounds represent hydrocarbons or hydrocarbonaceous compounds with at least 'n' carbon atoms.

As used herein, a "portion" of a stream represents at least one component present in the stream, a part of the stream, or a fraction of the stream.

As used herein, the term "about", when preceding a numerical value, has its usual meaning and also includes the range of normal measurement variations that is customary with laboratory instruments that are commonly used in this field of endeavor (e.g., weight, molar content, temperature or pressure measuring devices), such as within ±10% of the stated numerical value.

As used herein, the term "bottoms stream" refers to a process stream withdrawn from the lower portion of a column or vessel.

As used herein, the term "cascade-type refrigeration process" refers to a refrigeration process that employs a plurality of refrigeration cycles, each employing a different pure component refrigerant to successively cool natural gas.

As used herein, the term "closed-loop refrigeration cycle" refers to a refrigeration cycle wherein substantially no refrigerant enters or exits the cycle during normal operation.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided below.

As used herein, the terms "economizer" or "economizing heat exchanger" refer to a configuration utilizing a plurality of heat exchangers employing indirect heat exchange means to efficiently transfer heat between process streams.

As used herein, the term "fraction" refers to at least a part of a process stream and does not necessarily imply that the stream has been subjected to distillation.

As used herein, the terms "having," "has," and "have" have the same open-ended meaning as "comprising," "comprises," and "comprise," provided above.

As used herein, the terms "heavy hydrocarbon" and "heavies" refer to any component that is less volatile (i.e., has a higher boiling point) than methane.

As used herein, the terms "including," "includes," and "include" have the same open-ended meaning as "comprising," "comprises," and "comprise," provided above.

As used herein, the term "mid-range standard boiling point" refers to the temperature at which half of the weight of a mixture of physical components has been vaporized (i.e., boiled off) at standard pressure.

As used herein, the term "mixed refrigerant" refers to a refrigerant containing a plurality of different components, where no single component makes up more than 75 mole percent of the refrigerant.

As used herein, the term "natural gas" means a stream containing at least about 75 mole percent methane, with the balance being ethane, higher hydrocarbons, nitrogen, carbon dioxide, and/or a minor amount of other contaminants such as mercury, hydrogen sulfide, and mercaptan.

As used herein, the terms "natural gas liquids" or "NGL" refer to mixtures of hydrocarbons whose components are, for example, typically heavier than ethane. Some examples of hydrocarbon components of NGL streams include propane, butane, and pentane isomers, benzene, toluene, and other aromatic compounds.

As used herein, the term "open-loop refrigeration cycle" refers to a refrigeration cycle wherein at least a portion of the refrigerant employed during normal operation originates from the fluid being cooled by the refrigerant cycle.

As used herein, the term "overhead stream" refers to a process stream withdrawn from the upper portion of a column or vessel.

As used herein, the terms "predominantly," "primarily," "principally," and "in major portion," when used to describe the presence of a particular component of a fluid stream, means that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, the term "pure component refrigerant" means a refrigerant that is not a mixed refrigerant.

As used herein, the terms "upstream" and "downstream" refer to the relative positions of various components of a natural gas liquefaction facility along the main flow path of natural gas through the facility.

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying a natural gas stream, said process comprising:

(a) introducing at least a portion of said natural gas stream into a first distillation column;

(b) withdrawing a first predominantly liquid stream from said first distillation column via a first liquid outlet;

(c) heating at least a portion of said first predominately liquid stream in a first heat exchanger to provide a first heated stream;

(d) separating at least a portion of said first heated stream in a vapor-liquid separation vessel to provide a first heated vapor fraction and a first heated liquid fraction;

(e) heating at least a portion of said first heated liquid fraction in a second heat exchanger, wherein the second heat exchanger is a kettle-type shell-and-tube heat exchanger comprising a shell and an internal weir extending from the bottom of said shell part way towards the top of said shell, wherein said shell defines an internal volume, wherein said internal weir divides the internal volume into a first side and a second side, wherein said heating of step (e) takes place on said first side of said internal weir;

(f) withdrawing a second heated vapor fraction and a second heated liquid fraction from said second heat exchanger wherein said second heated liquid fraction is withdrawn from said second heat exchanger on said second side of said internal weir, wherein said second heated liquid fraction flows over an uppermost edge of said internal weir from said first side to said second side;

(g) introducing at least a portion of said first and/or second heated vapor fractions into said first distillation column via a first vapor inlet, wherein said first vapor inlet is located at a vertical elevation below said first liquid outlet; and (h) introducing at least a portion of said second heated liquid fraction into said first distillation column via a first liquid inlet, wherein said first liquid inlet is located at a vertical elevation below said uppermost edge of said internal weir.

2. The process of claim 1, further comprising, prior to step (a), cooling at least a portion of said natural gas stream in an upstream refrigeration cycle to thereby provide a cooled natural gas stream, wherein at least a portion of said natural gas stream introduced into said first distillation column comprises at least a portion of said cooled natural gas stream.

3. The process of claim 2, wherein said upstream refrigeration cycle comprises a propane, propylene, ethane, or ethylene refrigeration cycle.

4. The process of claim 1, wherein steps (a)-(h) are carried out without the use of a mechanical pressure increasing device.

5. The process of claim 1, wherein the liquid level of said vapor-liquid separation vessel is at substantially the same vertical elevation as said uppermost edge of said weir.

6. The process of claim 1, wherein the bottom of said vapor-liquid separation vessel and the bottom of said second heat exchanger are at substantially the same vertical elevation.

7. The process of claim 1, further comprising withdrawing a first predominately liquid bottoms stream from said first distillation column via a liquid bottoms outlet, wherein said liquid bottoms outlet is located below said first vapor inlet.

8. The process of claim 7, further comprising introducing at least a portion of said first predominantly liquid bottoms stream into a second distillation column.

9. The process of claim 1, wherein said heating of at least one of steps (c) and (e) is at least partially carried out by indirect heat exchange with at least a portion of said natural gas stream.

10. The process of claim 1, further comprising introducing at least a portion of said first heated vapor fraction into said first distillation column, wherein said at least a portion of said first heated vapor fraction introduced into said first distillation column does not pass through said second heat exchanger.

11. The process of claim 1, wherein at least one of said first and second heat exchangers is not a brazed aluminum heat exchanger.

12. The process of claim 1, wherein at least one of said first and second heat exchangers is a shell-and-tube heat exchanger.

13. The process of claim 1, further comprising cooling at least a portion of said natural gas stream via indirect heat exchange with a first pure component refrigerant, further comprising cooling at least a portion of said natural gas stream via indirect heat exchange with a second pure component refrigerant, further comprising withdrawing a first predominantly vapor stream from said first distillation column via a first vapor outlet, further comprising cooling at least a portion of said first predominately vapor stream via indirect heat exchange with a third pure component refrigerant, further comprising cooling at least a portion of said first predominately vapor stream via pressure reduction, wherein said first, second, and third pure component refrigerants have sequentially lower boiling points, wherein said cooling with said first pure component refrigerant is carried out upstream of said first distillation column, wherein at least a portion of said cooling with said second pure component refrigerant is carried out upstream of said first distillation column, wherein said cooling via pressure reduction and/or said cooling via indirect heat exchange with said third pure component refrigerant causes at least a portion of said first predominately vapor stream to condense into liquefied natural gas (LNG).

14. The process of claim 1, wherein said first distillation column comprises in the range of from 2 to 10 theoretical stages.

15. The process of claim 13, wherein said first predominately vapor fraction comprises at least 65 mole percent methane.

16. The process of claim 1, wherein the overhead temperature of said first distillation column is in the range of from about −200 to about −75° F., wherein the overhead pressure of said first distillation column is in the range of from about 20 to about 70 barg.

17. The process of claim 1, further comprising producing LNG via steps (a)-(h) and vaporizing at least a portion of the produced LNG.

18. The process of claim 1, wherein at least one of said first heat exchanger and said second heat exchanger is a kettle-type shell-and-tube exchanger.

* * * * *